United States Patent [19]

Henderson

[11] 4,180,052

[45] Dec. 25, 1979

[54] FURNACE FIREPLACE APPARATUS HAVING SEPARATE COMBUSTION AND HEATING AIR SYSTEMS AND SETTLING CHAMBERS FOR PARTICULATE MATTER

[76] Inventor: Delbert H. Henderson, c/o General Delivery, Prescott Valley, Ariz. 86312

[21] Appl. No.: 952,714

[22] Filed: Oct. 19, 1978

[51] Int. Cl.[2] ..... F24H 3/00; F24C 15/30

[52] U.S. Cl. ..... 126/108; 110/297; 126/67; 126/69; 126/75; 126/104 R; 126/123; 126/126

[58] Field of Search ..... 126/108, 104 R, 104 A, 126/83, 69, 74, 75, 297, 293, 299 F, 307 A, 66, 67, 123, 126; 110/97 R, 97 C, 148, 83, 163; 431/115; 432/72

[56] References Cited

U.S. PATENT DOCUMENTS

| | | | |
|---|---|---|---|
| 261,884 | 8/1882 | Weir | 126/108 |
| 283,440 | 8/1883 | Tungfer | 126/108 |
| 378,101 | 2/1888 | Miller | 126/108 |
| 511,194 | 12/1893 | Braddock | 126/108 |
| 753,104 | 2/1904 | Pelmulder | 126/67 |
| 1,144,117 | 6/1915 | Frederickson | 126/67 |
| 1,855,566 | 4/1932 | Bollinger | 126/108 |
| 1,958,491 | 5/1934 | Nelson | 126/108 |
| 1,990,827 | 2/1935 | Iler | 126/108 |
| 2,296,545 | 9/1942 | Tichbourne | 126/108 |
| 2,508,131 | 5/1950 | Zink | 126/108 |

*Primary Examiner*—Samuel Scott
*Assistant Examiner*—Daniel J. O'Connor
*Attorney, Agent, or Firm*—H. Gordon Shields

[57] ABSTRACT

Fireplace furnace apparatus includes separate air systems for combustion and for heating and the combustion gases flow from a primary combustion chamber into a secondary combustion chamber and into additional settling chambers for particulate matter and the heated air flows through finned chambers adjacent the chambers through which the combustion air flows.

47 Claims, 24 Drawing Figures

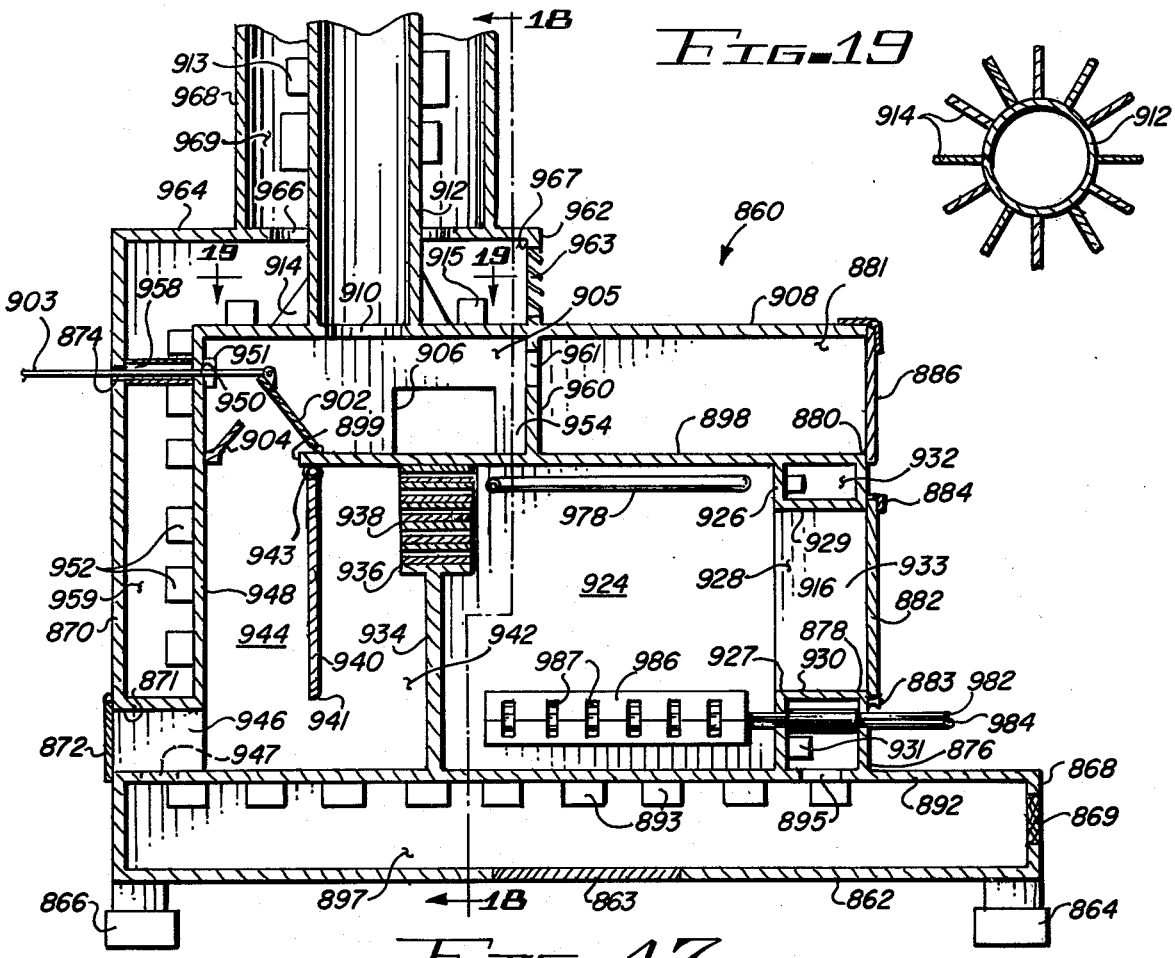
FIG. 19
18
913
968
969
964
966
912
967
962
963
860
914
912
19
915
19
914
910
905
908
881
903
958
874
951
906
961
886
950
902
960
954
898
880
904
899
932
884
938
978
926
929
943
952
936
928
916
933
959
948
924
882
870
944
934
942
878
940
987
986
927
930
871
883
982
946
941
984
872
947
931
876
868
892
893
895
869
897
18
863
862
866
864
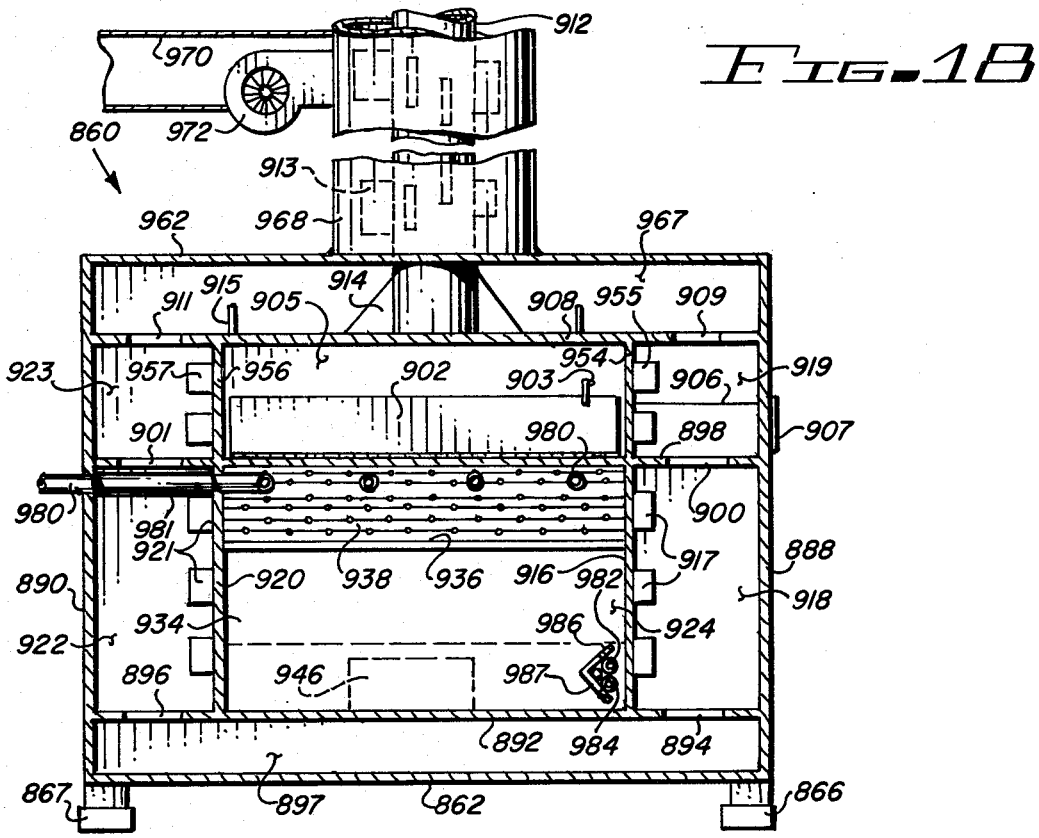
FIG. 17
FIG. 18
912
970
860
972
913
962
968
967
911
915
905
914
908
955
909
923
957
956
902
903
954
906
919
901
980
898
907
980
981
900
921
938
936
916
982
917
888
890
920
934
986
924
918
922
896
946
987
892
984
894
867
897
862
866

FURNACE FIREPLACE APPARATUS HAVING SEPARATE COMBUSTION AND HEATING AIR SYSTEMS AND SETTLING CHAMBERS FOR PARTICULATE MATTER

BACKGROUND OF THE INVENTION

1. Field of the Invention

This invention relates to a combustion apparatus and, more particularly, to combustion apparatus having the features of both fireplaces and furnaces.

2. Description of the Prior Art

The heating of homes is primarily accomplished by furnaces using either gas or fuel oil as a fuel. Past generations have also used wood and coal as fuels. A typical furnace installation includes the use of a blower which passes air over or around a combustion chamber or chambers and by a heat exchange process the air is warmed. The warm air is then circulated throughout the home or structure in which it is located by a network or system of ducts. The combustion gases are vented to the atmosphere through a chimney flue arrangement.

Another method of heating a home, such less efficient than a furnace, is a fireplace. The fireplace is, of course, a much older method of heating a home, and is not used primarily in contemporary structures for heating a home, but rather is used for aesthetic purposes, with heat derivation a secondary purpose. Typically, a fireplace puts out only a limited amount of heat into the room in which it is disposed. An improvement over the "normal" fireplace is the so-called "heatalator" fireplace in which a metal shell is inserted within a brick (ceramic or rock) facing. The metal shell comprises the combustion chamber and thence through the facing allows air to circulate to a limited extent about the metal shell for heat transfer purposes. The heated air is then vented to the room in which the apparatus is disposed. There are other variations of the "heatalator" apparatus, but they function basically in the same way.

Another type of fireplace apparatus, somewhat more efficient than the enclosed fireplace, is the free-standing fireplace which is a metal shell disposed in a room. This type of apparatus is more efficient than that described in the previous paragraph due simply to the fact that air from a room circulates around the combustion chamber shell and thus more heat is exchanged. An additional advantage in the free-standing fireplace is that a wall is not needed, and the expense of a hearth and the masonry associated with the built-in type fireplace is eliminated.

Wood is the principal source of fuel for virtually all types of fireplaces. Regardless of the type of fireplace, wood is virtually the only type of fuel burned. Andirons or some other type of grate is disposed in the fireplace and the wood fuel is disposed thereon for combustion purposes.

In the heating apparatus described above, the type of fuel is extremely limited. The limitations are imposed by the apparatus themselves, with respect to the furnaces, and, with respect to the fireplace, the limitations are due to the inherent characteristics of fireplaces particularly with their limited ability to provide sufficient air (oxygen) for the combustion of various types of trash or refuse whose burning characteristics are different from ordinary wood, such as logs. The types of trash available for combustion, and which produce substantial heat when burned, include newspapers, cardboard, sawdust, wood chips, rubber dust, dried organic material, and the like.

Incinerators are virtually the only type of combustion apparatus which may burn such refuse. The availability of refuse, and the decreasing availability of wood logs, and the like, for formal fireplace consumption, and the decreasing availability and higher costs of gas, heating oil, and the like, make the use of trash an attractive fuel, provided the problems associated with trash may be eliminated.

Among the problems associated with the burning or combustion of trash are smoke, odor, increased oxygen demands, and ash residue. Heretofore, only expensive incinerators, such as commercially used, were able to overcome the problems to even a limited extent with respect to the combustion of trash.

The apparatus of the present invention combines the features of furnaces, fireplaces, and incinerators, in providing a relatively efficient heating apparatus for homes and the like, and allows the use of a very wide range of materials for combustion purposes. Trash, as well as wood, may be burned in the apparatus of the present invention without the problems of odor, pollution, and the like.

SUMMARY OF THE INVENTION

The apparatus disclosed and claimed herein comprises a primary and secondary combustion chamber for the substantially complete burning of a wide variety of fuels and for the elimination of a substantial amount of pollution. The apparatus also includes the provisions of air jets for supplying oxygen in the form of compressed air for substantially complete combustion of a wide variety of combustible materials. The apparatus also provides makeup air from outside the structure in which the apparatus is disposed to prevent negative pressure problems within the structure.

Among the objects of the present invention are the following:

To provide new and useful combustion apparatus;

To provide new and useful furnace apparatus;

To provide new and useful fireplace apparatus;

To provide new and useful incinerator apparatus for heating a structure;

To provide new and useful apparatus for burning trash and refuse;

To provide new and useful apparatus for providing makeup air in a combustion apparatus to prevent negative pressure problems within a structure in which the apparatus is disposed;

To provide new and useful apparatus for the combustion of a wide variety of fuels;

To provide new and useful heating apparatus having a plurality of heated chambers disposed about a combustion chamber;

To provide new and useful combustion apparatus having a plurality of settling chambers for residual products of combustion;

To provide new and useful heater apparatus using compressed air in a combustion chamber;

To provide new and useful heat apparatus having a primary combustion chamber and a secondary combustion chamber;

To provide new and useful furnace fireplace apparatus having a plurality of settling chambers for particulate matter;

To provide new and useful apparatus for burning exotic fuels for heating purposes;

To provide new and useful furnace fireplace apparatus having a relatively long flow path for the gaseous products of combustion, including particulate matter;

To provide new and useful furnace fireplace apparatus having a plurality of settling chambers for fly ash in which the settling chambers also comprise secondary combustion chambers for burning the products of incomplete combustion; and To provide new and useful furnace apparatus having a primary combustion chamber and a plurality of secondary combustion chambers.

BRIEF DESCRIPTION OF THE DRAWING

FIG. 17 is a view in partial section of an alternate embodiment of the apparatus of the present invention.

FIG. 18 is a view in partial section of the apparatus of FIG. 17 taken generally along line 18—18 of FIG. 17.

FIG. 19 is a view in partial section of a portion of the apparatus of FIG. 17 taken generally along line 19—19 of FIG. 17.

DESCRIPTION OF THE PREFERRED EMBODIMENT

Figure 1:
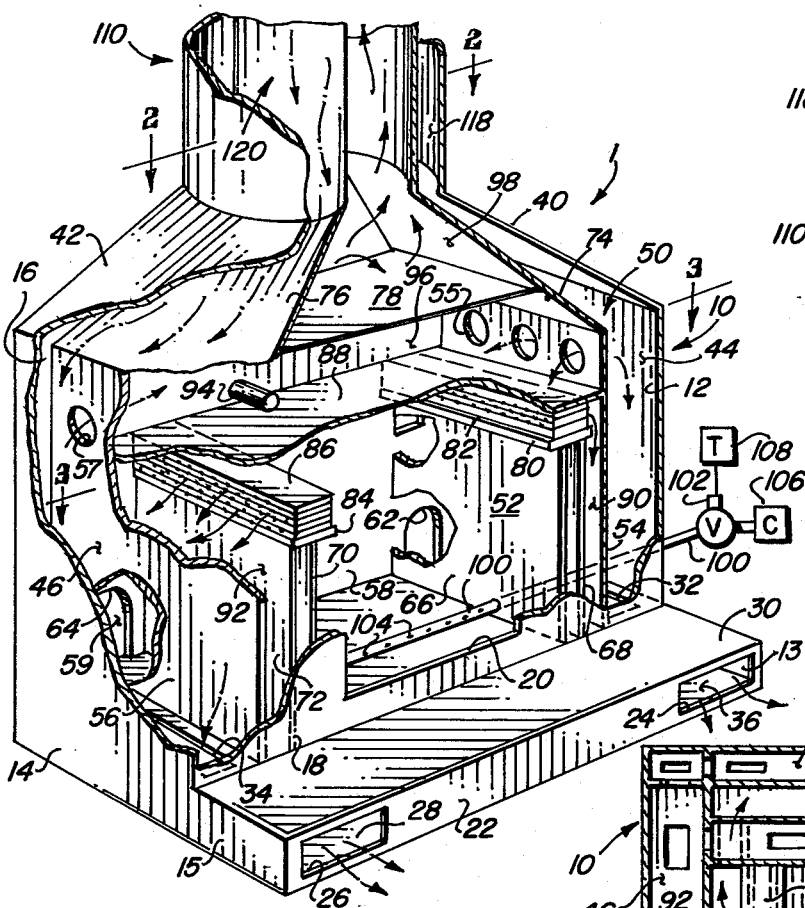
FIG. 1 is a perspective view, partially broken away, of apparatus embodying the present invention.

FIG. 1 is a perspective view, with portions cut away, of furnace fireplace apparatus 1 of the present invention. The furnace fireplace apparatus will sometimes hereinafter be referred to as "furplace" apparatus, signifying a combination of the properties, characteristics, or qualities of both a furnace and a fireplace. The furplace apparatus 1 includes an outer shell 10 which comprises a metal cabinet covering an inner cabinet 50. The two cabinets are spaced apart to provide for the circulation of air to be heated.

The outer shell provides a right side panel or wall 12 which is substantially vertically extending, and it includes a lower front extension 13 which extends forwardly from the right panel at the lower portion thereof. The outer shell 10 also includes a left side panel or wall 14, with a lower front extension 15, and the left side panel or wall is substantially identical to the right side panel, but spaced apart therefrom.

Above the front extensions 13 and 15 is a front panel or wall 18 which extends between the right and left side panels. The front panel or wall 18 includes an opening 20 for a door. The opening 20 is used to place fuel into the interior of the furplace apparatus 1. The opening 20 is appropriately closed by a door, not shown. The back of the outer shell 10 is closed by a rear panel or wall 16, which extends substantially perpendicular to the right and left side panels 12 and 14, and is seemingly secured to them. Preferably, the outer shell is welded together. In actuality, all of the various panels, walls, elements, or component parts of the apparatus of the present invention are preferably welded together, and will be so understood hereafter, as when the term "secured" is used, unless it is stated otherwise, or unless it is obvious that a part or element is a moving part. Obviously, it is important to keep heated air separate from combustion air and from combustion gases and residue. Appropriate sealing, in addition to welded joints or seams, is accordingly used and will be so understood.

A front lower panel 22 extends between the lower front extensions 13 and 15 to which it is sealingly, as by welding, secured. The lower front panel 22 is substantially parallel to the front panel or wall 18. The lower front panel 22 includes a pair of openings 24 and 26 which communicate with a bottom chamber 36, which will be described in detail below.

Beneath the apparatus is a bottom plate 28. The bottom plate 28 may be a separate piece of metal (steel) appropriately secured to the outer shell 10, or it may be the base or other slab on which the furplace apparatus 1 is disposed.

Spaced apart from the bottom 28, and secured to the outer shell 10 and extending between the right and left side panels or walls and between the rear panel or wall 16, and beneath the front panel or wall 18, to which it is secured, and to the lower front panel 22, is a hearth 30.

The hearth 30 comprises the top to the bottom chamber 36 and it also comprises the floor for the inner shell 50 and accordingly the floor or bottom for a firebox 52.

Above the right and left side panels or walls 12 and 14 are a pair of upwardly and inwardly inclined right and left wall panels 40 and 42, respectively. All of the panels of the outer shell 10 are appropriately secured together, as by welding, as previously mentioned.

Disposed within the outer shell 10 is the inner shell 50, which includes a firebox or combustion chamber 52. The firebox or combustion chamber 52 comprises a primary combustion chamber in which burning of a wide variety of materials may take place.

The inner shell 50 includes a right outer wall 54 and a left outer wall 56, both of which are substantially parallel to each other and spaced apart from their respective right and left walls of the outer shell 10. The rear wall 58 extends between the right and left outer walls 54 and 56 and is sealingly secured thereto and to the floor 30. The rear wall or panel 58 is spaced apart from an inner rear wall 48, which extends between walls 54 and 56 and defines a secondary settling chamber 59 therebetween. The wall 48 is spaced apart from the rear panel or wall 16 of the outer shell 10 and an air chamber 49 is defined therebetween, and also between the outer walls 54 and 56 of the inner enclosure.

Spaced apart from the right and left outer walls 54 and 56 are a pair of right and left inner and center walls, including a right inner wall 66 and a right center wall 68, and a left inner wall 70 and a left center wall 72. The inner and center walls are spaced apart from each other and spaced apart also from the outer walls 54 and 56. The inner and center walls are all secured to the rear wall 58 of the inner shell 50 and to the front wall 18 of the outer shell 10.

A plate 80 is disposed on, and secured to, the right inner and center walls 66 and 68. The plate 80 is generally horizontally extending between the front wall 18 of the outer enclosure 10 and the rear wall 58 of the inner shell or enclosure 50. A similar plate 84 is secured to the top of the left inner and center walls 70 and 72. The plates 80 and 84 are substantially identical, and both of them are disposed horizontally on the top of their respective walls and extend between the front wall 18 and the rear wall 58. Ceramic smoke scrubbers or spark arrestor grids 82 and 86 are appropriately disposed on the plates 80 and 84, respectively. The ceramic smoke scrubbers or grids comprise ceramic material through which extend a plurality of horizontally extending apertures or passageways. The grids are heated to an elevated temperature by the combustion in the combustion chamber 52. As the products of combustion rise from within the firebox or primary combustion chamber 52, the products flow through the smoke scrubbers where some combustion of the products takes place and into a pair of secondary combustion chambers 90 and 92, disposed respectively between the outer walls 54 and 56 and their adjacent inner center walls 66 and 72, respectively. Further combustion takes place in the secondary combustion chambers.

A plate 88 is disposed on top of the ceramic smoke scrubbers 82 and 86 and extends between the front wall 18 of the outer enclosure 10 and the rear wall 58 of the inner enclosure or shell 50. The plate 88 defines the top of both the primary combustion chamber and the secondary combustion chambers. The secondary combustion chambers also comprise primary settling chambers where the velocity of the combustion gases, with ash and other solid particulate matter flowing therewith, slows down sufficiently to allow some of the heavier particulate matter to settle out in the chambers.

A pair of upwardly and inwardly extending panels 74 and 76 are secured to the top of the outer walls 54 and 56 of the inner shell or enclosure 50. An upper plate 78 extends between the incline panels 74 and 76 to which the upper plate 78 is secured. The plate 78 is spaced apart from the plate 88 and a chamber 96 is defined between the plates 78 and 88, which comprise the top and bottom portions of the chamber, the plate 58, which defines the back panel or rear wall of the chamber, and the outer walls 54 and 56 which comprise the outer or side walls of the chamber 96. The front panel 18 comprises the front wall of the chamber 96. The chamber 96 communicates through a plurality of apertures 55 and 57 which extend respectively through the upper portion of the outer walls 54 and 56 between the plate 88 and the top incline panels 74 and 76, respectively, with a pair of chambers 44 and 46, which chambers are defined respectively between the right and left portions of the outer and inner enclosures. The chambers 44 and 46 communicate with the bottom chamber 36 through a plurality of apertures 32 and 34 which extend through the floor 30.

From the primary combustion chamber 52, the combustion gases flow through the ceramic smoke scrubbers or grids 82 and 84 into the chambers 90 and 92, which comprise secondary combustion chambers for the continued combustion for the gases and for settling out the particulate matter in the combustion gases. The smoke or products of combustion are heated to a sufficiently high temperature as they flow through the grids, once the grids are heated to about 1200 degrees F., so that additional combustion of the smoke and odors takes place within the secondary combustion chambers 90 and 92. The path of the combustion gases is sufficiently long and tortuous that the heat buildup from the primary combustion chamber 52 raises the temperature of the combustion gases in the chambers 90 and 92 to provide for the secondary combustion. From the chambers 90 and 92, the combustion gases flow through a pair of arches 62 and 64 in the lower portion of the rear wall 58 to a smoke chamber 59 between the rear wall 58 of the inner shell or enclosure 50 and the rear wall 16 of the outer shell or enclosure 10. Fly ash and other particulate matter in the products of combustion settle to the bottom of the chambers 90, 92, and 59. Accordingly, the combustion air which rises from chamber 59 is substantially free of particulate matter. The combustion gases from chamber 59 flow upwardly and through a damper, not shown, into a chamber 98 disposed above the upper plate 78 and beneath the upper incline panels 74 and 76. A damper actuating rod 94 is shown extending through rear wall 58 and chamber 96. The design of the damper chamber and the operation of the damper is substantially identical to those discussed in detail in conjunction with other embodiments. From the chamber 98 the combustion gases flow upwardly through a finned cylindrical inner stack inner stack 120.

The upper portion of the outer shell or enclosure 10 terminates at, and is secured to, an outer stack 110. The outer stack 110 communicates directly with the chambers 44 and 46 defined between the inner enclosure 50 and the outer enclosure 10. The outer stack 110 is of a generally circular configuration.

The inner stack 120 is connected to, and disposed above, the inner shell 50. The inner stack 120 is also of a generally smooth, steel cylindrical configuration. The combustion gases extend upwardly from the chamber 98 into the interior of the inner stack 120 and the gases accordingly flow outwardly of the structure in which the furplace apparatus is disposed.

Between the outer and inner stacks 110 and 120, respectively, is a chamber 118 through which air flows for heating purposes. The air flow through the chamber 118 receives heat from the inner stack and communicates directly with the chambers 44, 46, and 96, and ultimately 36. The air absorbs heat from the inner enclosure, and from chamber 36, the heated air is distributed as desired. The heated air may be distributed directly into the room in which the furplace apparatus 1 is disposed through the openings 24 and 26, and/or the heated air may be transmitted throughout the structure by appropriate duct work, as desired.

Figure 2:
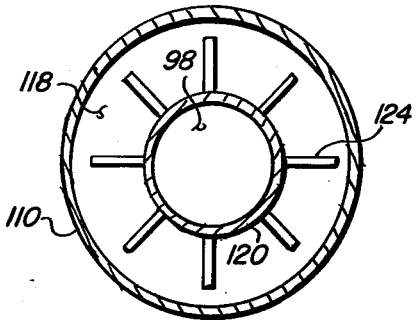
FIG. 2 is a view of the apparatus of FIG. 1 in partial section taken generally along line 2—2 of FIG. 1.

FIG. 2 is a view in partial section of the apparatus of FIG. 1 taken generally along line 2—2 of FIG. 1. It comprises a view in partial section of the outer stack 110, and the inner stack 120 disposed within the outer stack 110.

The outer stack 110 and the inner stack 120 comprise a pair of concentric cylinders spaced apart from each other a specific or predetermined radial distance.

The inner stack 120 is substantially identical to the outer stack 110 except that its diameter is less than that of the outer stack. The inner stack 120 includes radially outwardly extending fins 124 secured to the outer periphery of the stack. The fins 124 are of a predetermined radially outwardly extending length and width and are spaced apart. The fins 124 overlap vertically to provide additional heat transfer area for the transfer of air moving through chamber 118 between the outer and inner stacks. The inner stack 120 communicates directly with the chamber 98.

Figure 3:
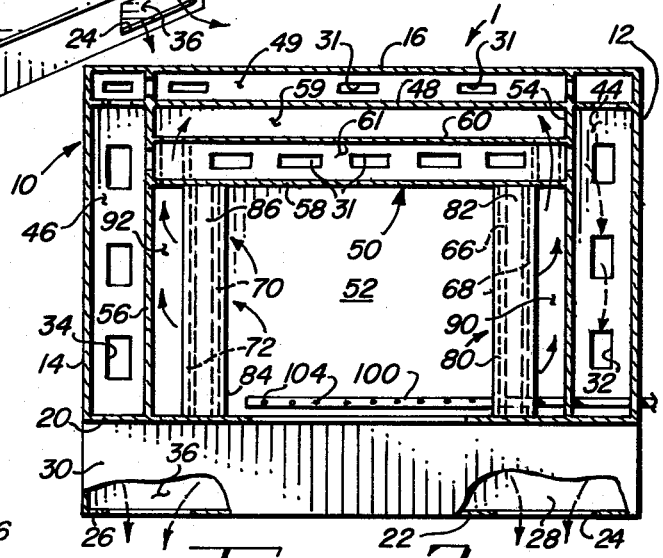
FIG. 3 is a view in partial section of a portion of the apparatus of FIG. 1 taken generally along line 3—3 of FIG. 1.

To provide appropriate air (oxygen) to the primary combustion chamber 52, a pressurized air line 100 is shown extending through the walls 12, 54, 68, and 66, and extending inwardly into the lower portion of the chamber 52 above the floor 30, as shown in both FIGS. 1 and 3. The air line 100 includes a solenoid valve 102 to control the air flow, from a pressure source, flowing into the combustion chamber. For distribution of the air within the combustion chamber 52, the air line 100 includes a plurality of holes or jets 104. Actually the line 100 is disposed in a larger pipe.

Since some combustible materials require more air (oxygen) than other materials, the air line may be used as desired. Preferably, the air line 100 is connected to a source of compressed air, such as a compressor 106. The air flowing through the line 100 into the combustion chamber 52 is controlled by the solenoid valve 102 located at the compressor. By use of the compressed air to the line 100, the furplace apparatus 1 provides sufficient air (oxygen) to allow for the complete combustion of virtually any type of combustible material, refuse, and the like. If desired, a movable manifold may be connected to the air line 100 which allows the air jets 104 to be directed in a specific direction within the chamber 52.

The compressor 106 is well known and understood. The solenoid valve 102 is controlled by a thermostat 108. When the room thermostat 108 calls for heat, the solenoid 102 opens the air line 100 to provide air to the jets 104. An appropriate pressure regulator is also provided at the air compressor, located at the solenoid valve. The valve, compressor, and thermostat are well known and understood, and are accordingly only schematically represented in FIG. 1.

Figure 8:
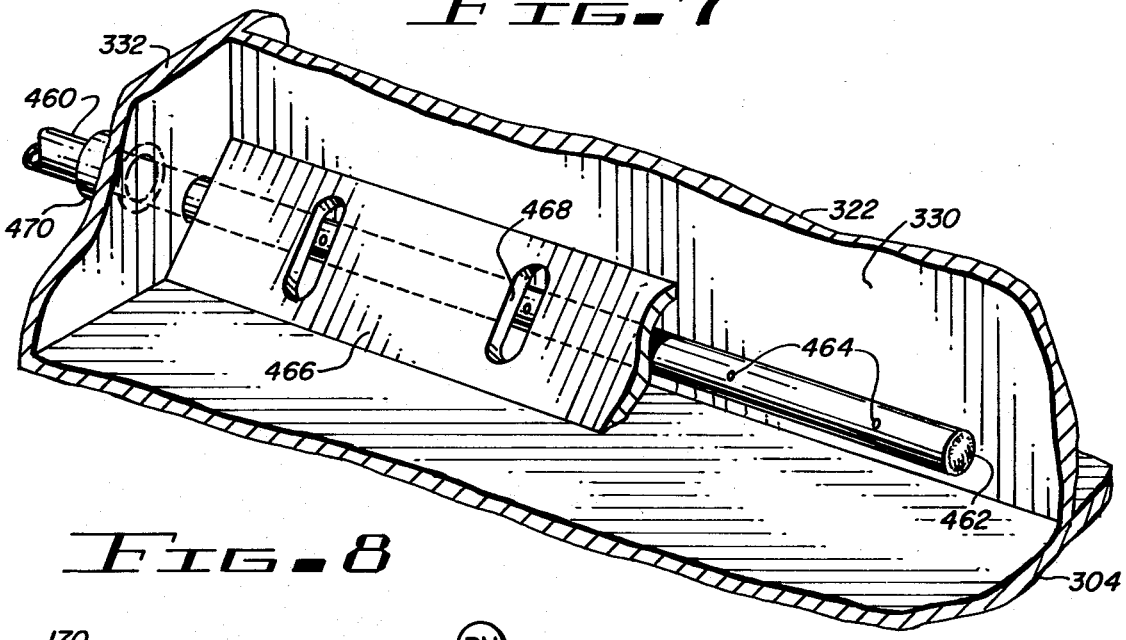
FIG. 8 is a perspective view of a portion of the combustion chamber of the apparatus of FIGS. 5—7.
Figure 20:
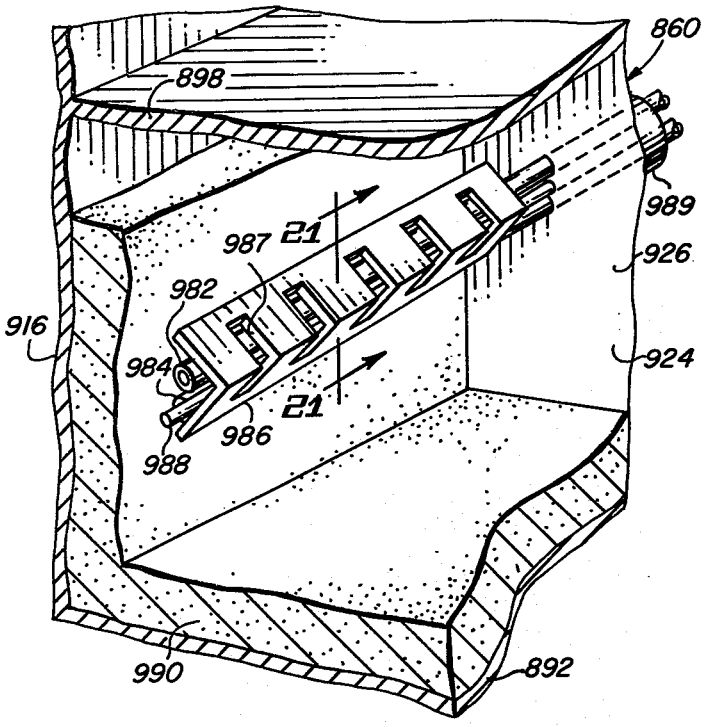
FIG. 20 is a perspective view of a portion of the apparatus of the present invention illustrating details of firebox construction.
Figure 21:
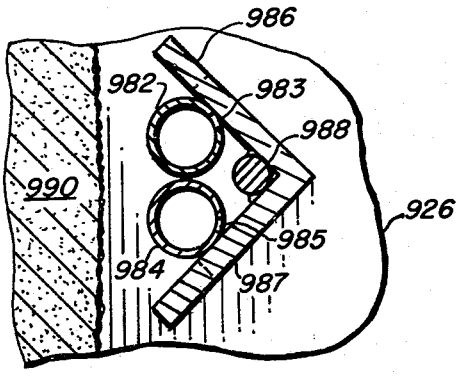
FIG. 21 is a view in partial section of the apparatus of FIG. 20 taken generally along line 21—21 of FIG. 20.

The portion of the air pipe 100 disposed within the firebox 52 of the furplace apparatus 1 is preferably made of stainless steel for its heat resistant properties. The pipe is also preferably disposed in a manifold or behind a plate, as shown in FIGS. 8, 20, and 21.

FIG. 3 is a view in partial section of the apparatus of FIG. 1 taken generally along line 3—3 of FIG. 1. It comprises a vertical plan view of the furplace apparatus 1 looking downwardly through the outer enclosure 10 and the inner enclosure 50. The walls or wall panels 12, 14, and 16 of the outer enclosure 10 are shown, as in the front wall 20 and the lower front wall 22. The outer enclosure 10 is of a generally rectangular configuration, with the various walls disposed appropriately at right angles to adjacent walls. The floor 30 extends beyond the front wall 20 to the lower front wall 22 and forwardly of the front wall 20. It comprises the top plate or top wall for the plenum chamber 36 which extends beneath the apparatus and serves as a distribution chamber for the heated air. The heated air flows outwardly from the chamber 36 through the pair of openings 24 and 26 in the front wall 22. If desired, as indicated above, appropriate ducts may also be connected to the chamber 36 for distribution of the heated air, as desired. A blower 228 (see FIG. 4) moves the air downwardly.

The inner enclosure 50 includes a pair of side walls, including outer walls 54 and 56 which are secured to, and extend between, the rear wall 16 and the front wall 20 of the outer enclosure 10. The rear wall 58 of the inner enclosure extends between, and is appropriately secured to, the outer side walls 54 and 56. The rear wall 58 is also secured at its bottom portion to the floor plate 30. Parallel to, and between, the rear wall 58 and the outer wall 16 is a pair of walls 60 and 48. Between the walls 60, 48, 54, and 56 is the smoke chamber 59. A rear heated air chamber 49 is between the walls 16, 48, 54, and 56. An inner heated air chamber 61 is defined between the walls 54, 56, 58, and 60. The chambers 49 and 61 communicate with the plenum chamber and the adjacent heated air chambers through appropriate apertures, such as apertures 31.

Heated air and combustion air, including gaseous products of combustion and particulate matter, flow separately in chambers defined by the walls, panels, or plates. In FIGS. 1 and 3, solid line arrows denote the flow of combustion air and dotted line arrows denote the flow of heated air.

Extending between the front wall 20 of the outer enclosure and the rear wall 58 of the inner enclosure are two pairs of spaced apart walls, shown in phantom in FIG. 3, including the right inner wall 66 and the right center wall 68, and the left inner wall 70 and the left center wall 72. Heated air flows between the walls and communicates with the plenum chamber 36 and also with a chamber 61 defined between the rear wall 58 and the spacer wall 60. The chamber 61 also communicates with chambers 44 and 46, through apertures in the walls 54 and 56, respectively, and with plenum chamber 36 through appropriate apertures 31 in the floor 30.

The right and left inner and center walls extend between, and are appropriately secured to, the front wall 20 and the rear wall 58 of the combustion chamber. The primary combustion chamber 52 is defined between the front wall 20, the rear wall 58, and the inner walls 66 and 70.

The plates 80 and 84 are disposed on top of, and secured to, the respective right inner and center walls and the left inner and center walls. The plates support the ceramic smoke scrubbers 82 and 86. For clarity, with respect to FIG. 3, the plurality of conduits or apertures extending through the smoke scrubbers 82 and 86 are not shown in FIG. 3. Combustion gases, including particulate matter, flow from the combustion chamber 52 through the respective smoke scrubbers and into the secondary combustion chambers 90 and 92, defined between the center plates and the adjacent side walls, and the front wall 20 and rear wall 58. From the secondary combustion chambers 90 and 92, the combustion gases flow into the smoke chamber 59 through a pair of arches in the rear wall 58, shown in FIG. 1. Fly ash and other particulate matter produced during the combustion process settles out to the bottom of the chambers 90, 92, and 59, from whence the particulate matter may be removed. The smoke scrubbers also are spark arresters.

From the smoke chamber 59, the combustion gases flow upwardly, through a damper, and ultimately out of the structure in which the furplace apparatus 1 is disposed through the inner stack 120, shown in FIGS. 1 and 2.

The air line 100 is shown extending into the firebox or combustion chamber 52. The plurality of holes or jets 104 in the air line 100 allow compressed air to be transmitted into the firebox 52 to provide oxygen for the combustion of a wide variety of fuels.

Figure 4:
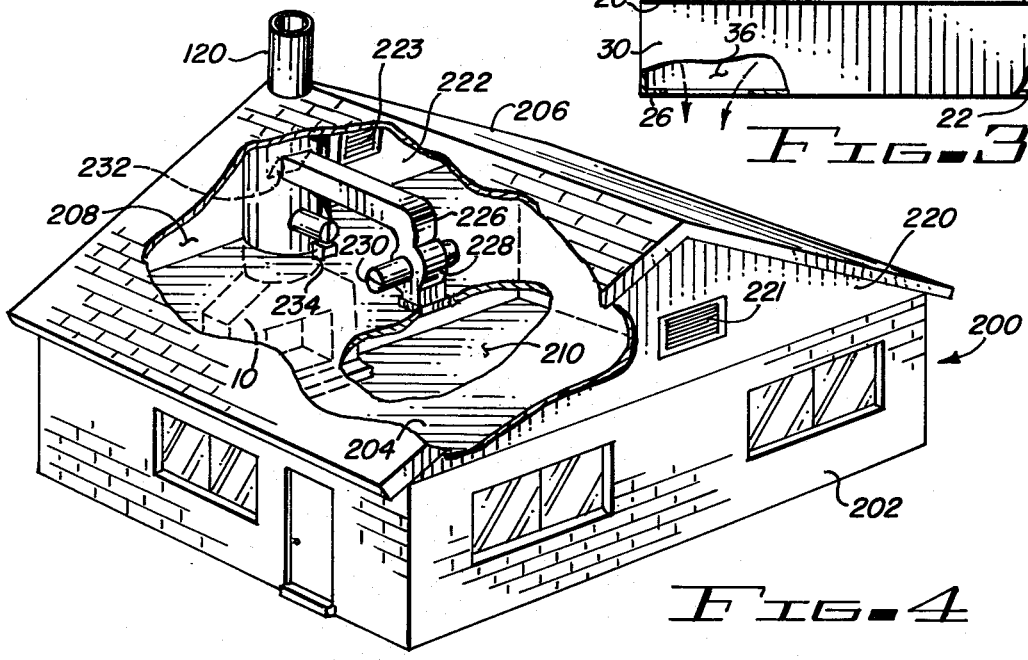
FIG. 4 is a perspective view, partially broken away, of a home (structure) illustrating the installation of the apparatus of the present invention.

FIG. 4 is a perspective view, partially broken away, of a home or structure 200 illustrating the installation of the furplace 10 in the structure 200. The structure is broken away to illustrate the air circulation system employed with the furplace.

The home or structure 200 includes a plurality (four, as shown) of exterior walls 202. A pitched roof 206 is disposed above the exterior walls and the exterior walls include a pair of gables 220 and 222 which extend above the end walls beneath the pitched roof 206. Within the structure is a ceiling 204 and beneath the ceiling is a room 210. Between the ceiling 204 and the roof 206 is an attic 208.

The furplace 10, illustrated in FIGS. 1–3, above, is disposed against one wall of the structure and within the room 210. Preferably, the furplace apparatus 10 is disposed against an exterior wall. The chimney 110 extends above the furplace 10, through the ceiling 204, and upwardly through the roof 206.

The attic 208 is vented at the gabled ends 220 and 222 by a pair of vents 221 and 223, which extend through the gables 220 and 222, respectively. The two vents 221 and 223 may be of any conventional design. They serve to maintain outside or ambient atmospheric pressure in the attic 208. With the air system employed in the present system, a minimum of two vents is required to insure that the pressure in the attic is outside atmospheric ambient pressure.

Disposed within the attic 208 is ductwork 226 which connects the interior of the home 200, such as room 210, located below the attic, for return air. The ductwork 226 is connected to outer stack 110, and thus to the space 118 between the outer stack 110 in the inner stack 120 (see FIGS. 1 and 2). The circulation of the air is accomplished by means of a blower 228 disposed in the ductwork 226. The flow of air is from the room 210 upwardly through the blower 228, through the ductwork 226, into the space between the outer and inner stacks, and through the furnace apparatus illustrated above in FIGS. 1, 2, and 3. The air flow is accordingly downwardly through the furnace, where the air is heated, and the heated air then flows outwardly from the furnace apparatus, preferably at the bottom of the furnace, as illustrated in FIGS. 1 and 3, and as shown by the arrows.

By means of the blower 228, the air is circulated from the home, forced through the ductwork in the fireplace apparatus, and back into the room 210. Attic air, at outside ambient pressure, is mixed with the return air from the room 210 at the blower 228 through an adjustable damper 230. The damper 230 is adjusted to provide for the admittance of a predetermined amount of air, fresh from the attic, to be mixed with the normal, return airflow from the room 210. This assures that a predetermined quantity of fresh air will always be mixed with the normal return air flow.

A curtain 232 is shown in phantom in FIG. 4 as pivoting outwardly away from the ductwork 226 at the outer chimney stack 110. The curtain 232, preferably made of asbestos, or other relatively heavy, fireproof (or fire resistant) materials, is hingedly secured to the upper portion of the ductwork and is normally closed by gravity to prevent a reverse flow of air through the fireplace apparatus when no fire is in the fireplace apparatus. When the blower 228 is on, the positive flow of air through the duct 226 causes the curtain 232 to pivot outwardly and thus to open the ductwork to the space between the outer and inner chimneys, as described above. When the blower 228 is not running, the curtain 232 moves or pivots downwardly by gravity to close the ductwork. Thus the curtain provides the flow of air backwardly through the ductwork. However, with the furnace apparatus in an "off" condition, with no fire burning, the air within the home 200 will cool off and accordingly a negative pressure situation develops, caused by the exhaust action of the fireplace flue as the products of combustion, with its flow of gases, and the like, continues to move upwardly and outwardly through the inner stack 120. To compensate for the negative pressure, a barometric damper 234 is secured to the outer stack 110 within the attic 208. The barometric damper opens in response to the negative pressure within the home or structure 200 to admit air at atmospheric pressure from within the attic 208. This air compensates for the negative pressure within the structure resulting from the flow of air through the fireplace apparatus and outwardly of the structure through the inner stack 120. A negative pressure situation is thus avoided by the use of the barometric damper. At the same time, as long as the blower 228 is "on" and circulating the air from within the structure 200 through the fireplace apparatus, a predetermined amount of fresh air from the attic 208 is continually being added to the normal return air.

Figure 5:
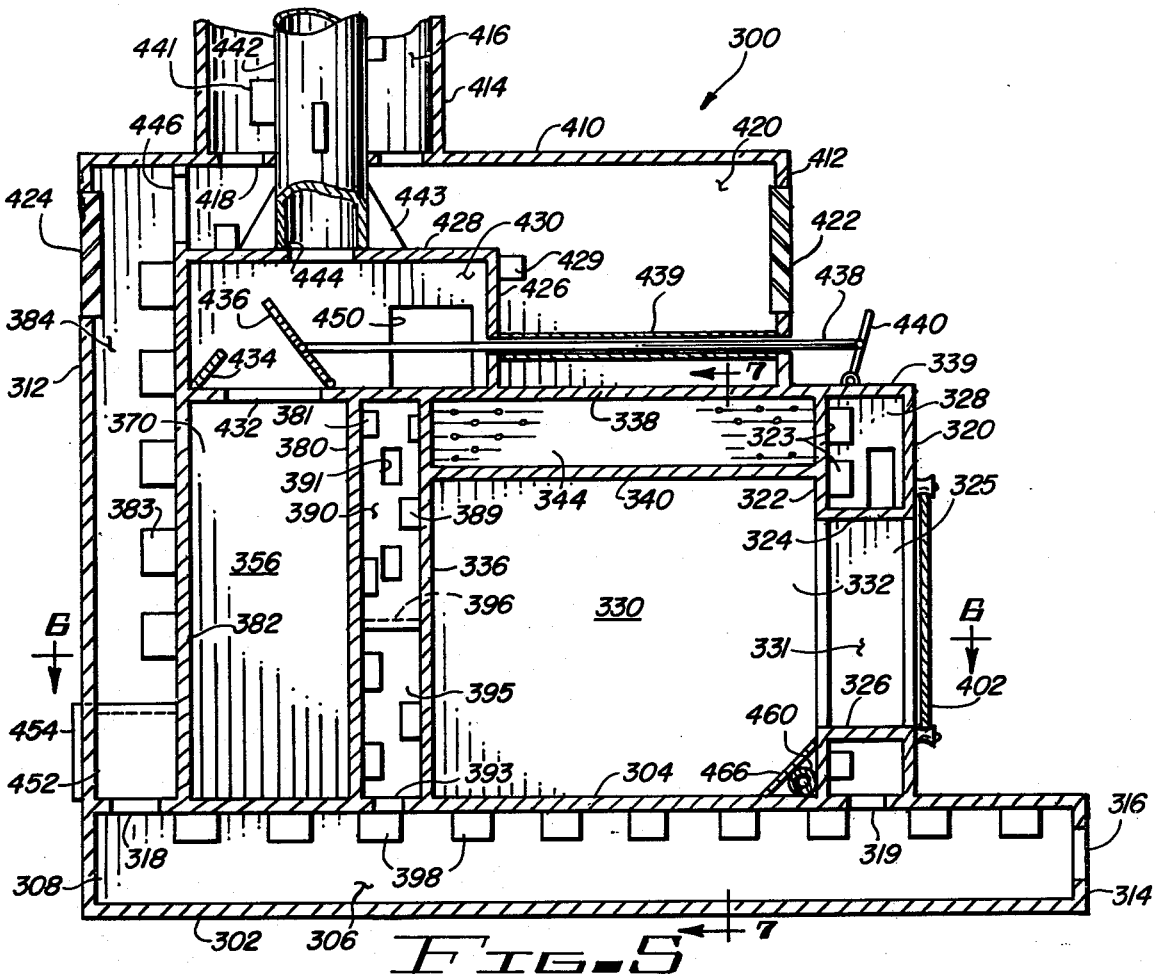
FIG. 5 is a view in partial section of an alternate embodiment of the furnace fireplace apparatus of FIG. 1.
Figure 6:
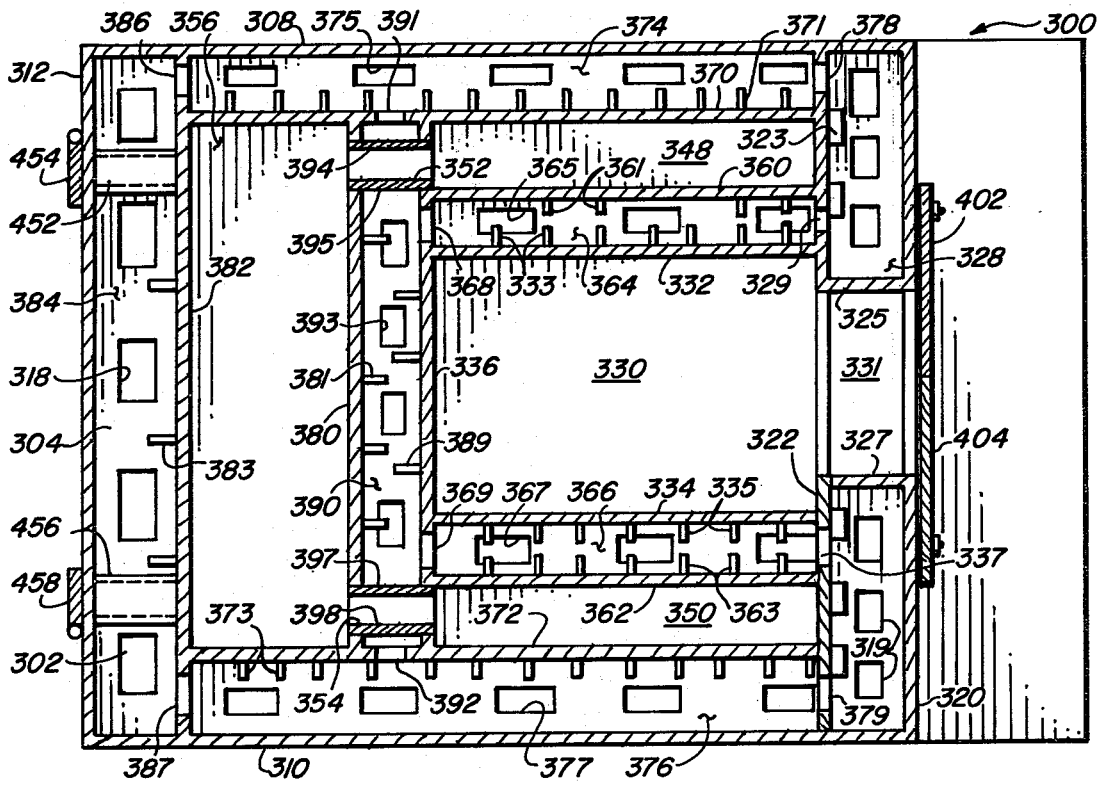
FIG. 6 is a view in partial section of the apparatus of FIG. 5 taken generally along line 6—6 of FIG. 5.
Figure 7:
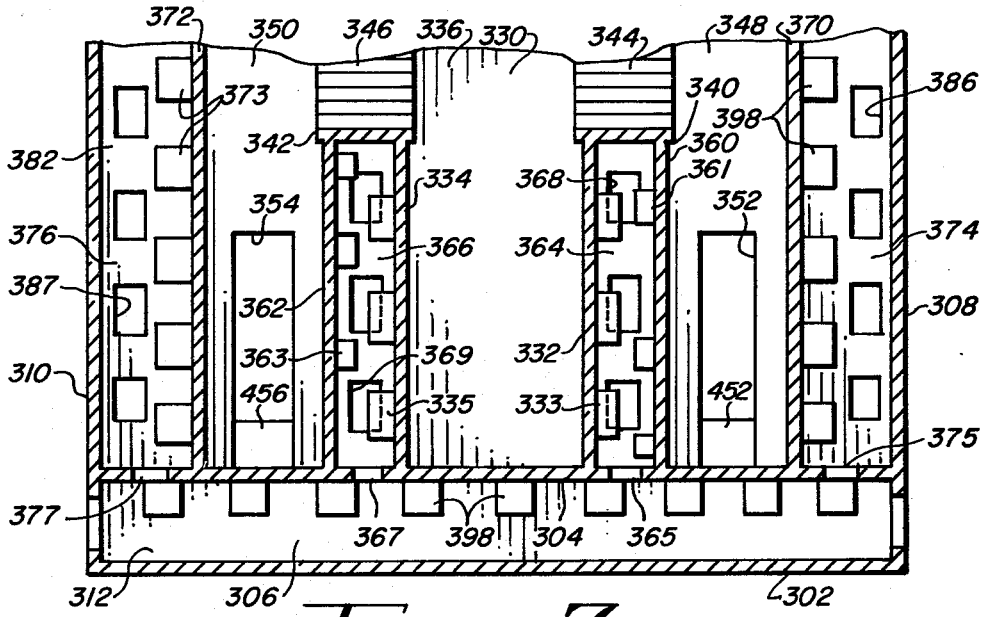
FIG. 7 is a view in partial section of a portion of the apparatus of FIG. 5 taken generally along line 7—7 of FIG. 5.

FIG. 5 is a view in partial section of an alternate embodiment of the furnace fireplace apparatus of FIGS. 1–3. FIG. 6 is a view in partial section of the fireplace furnace apparatus of FIG. 5 taken generally along line 6—6 of FIG. 5. FIG. 7 is a view in partial section of the furnace fireplace apparatus taken generally along line 7—7 of FIG. 5. The following descriptive material explaining the construction and operation of the fireplace furnace apparatus will refer to FIGS. 5, 6, and 7.

FIGS. 5, 6, and 7 illustrate fireplace furnace apparatus 300 which, like the furnace fireplace apparatus 1 discussed above, is preferably made out of sheets of steel for structural strength, heat transfer characteristics, and other considerations well known and understood in the art. The fireplace furnace apparatus 300 includes a bottom plate 302 spaced apart from a floor or hearth plate 304. A plenum chamber 306 is defined between the bottom plate 302 and the floor plate 304 by a pair of side walls 308 and 310. The side plate 308 may be referred to as the right side plate, and the side plate 310 may be referred to as the left side plate. The terms "right" and "left" refer to the respective sides of the fireplace apparatus as looking at the apparatus from the front. The term "floor" includes the term "hearth" as used in this application, since the hearth comprises the floor of the primary combustion chamber.

A back plate 312 closes the rear of the fireplace apparatus and also helps to define the plenum chamber 306. The front of the plenum chamber 306 is closed by a lower front plate 314, which includes a plurality of apertures or outlets 316. The apertures 316 allow for the circulation of the heated air outwardly into the room or structure in which the furnace fireplace apparatus 300 is disposed. The plenum chamber 306 is thus the final chamber for heated air which circulates between the respective walls or plates of the fireplace furnace apparatus, as will be explained in more detail. As best shown in FIG. 6, the floor or hearth plate 304 includes a plurality of apertures 318, 319, 365, 367, 375, 377, and 393, which communicate with the plenum chamber 306 from various heated air chambers to allow for the downward flow of the air into the plenum chamber.

At the front or forward end of the fireplace is an outer or front wall 320 which is secured at respective right and left ends to the side plates 308 and 310. Spaced apart slightly from the front wall 320 is a secondary front wall 322, which, with the front wall 320, provides for a double wall for the front end of the furnace fireplace apparatus. The double wall, in addition to providing extra space for air circulation, as discussed below, helps to maintain a relatively cool front for the apparatus 300. The radiant heat is thus minimized from the front. This is especially advantageous during warm (e.g., summer) weather, when the apparatus may be used to heat water.

As shown in FIG. 6, the width of the secondary front wall 322 is substantially the same as that of the front wall 320, which extends fully across the entire width of the fireplace furnace apparatus. The secondary front wall accordingly extends between the pair of outer side walls 308 and 310.

A primary combustion chamber 330 is defined by the secondary front wall 322, respective right and left combustion chamber walls 332 and 334, and a rear combustion chamber wall 336. The combustion chamber 330 is closed at its upper portion by a top wall or ceiling 338. The wall or ceiling 338 also comprises a plate which extends rearwardly of the combustion chamber and forwardly of the combustion chamber to define a front ledge 339 of the apparatus 300. The front ledge may be used as a hot plate, if desired. The front wall 320 is in turn secured to the front portion 339 of the top plate 338.

Extending between the secondary front wall 322, which comprises the front wall of the combustion chamber 330, and the rear combustion chamber wall 336, are a pair of grid shelves 340 and 342 of which right grid shelf 340 is shown in FIG. 5, and both grid shelves 340 and 342 are shown in FIG. 7. Disposed on the grid shelf 340 are a plurality of ceramic smoke scrubbers or grids 344, which are substantially the same as the ceramic smoke scrubbers or spark arresters 82 discussed above in conjunction with FIGS. 1 and 3, and shown in detail in FIG. 24. The smoke scrubbers or grids 344 extend between the front and rear walls of the combustion chamber 330 and upwardly from the shelf 340 to the ceiling plate 338, and communicate between the combustion chamber 330 and a settling chamber 348, shown in FIGS. 6 and 7. The second grid shelf 342, with a plurality of ceramic smoke scrubbers or grids 346 communicates between the combustion chamber 330 and the left settling chamber 350, substantially similar to the communication between the combustion chamber 330 and the right settling chamber 348, as best shown in FIG. 7.

By the term "communicate" it is meant that the smoke and particles of combustion from the combustion chamber 330 flow out of the combustion chamber through the grids 344 and 346. This flow of the combustion gases, with the particles of combustion, is accordingly upwardly from the combustion chamber 330, through the grids 344 and 346, and into the respective settling chambers 348 and 350. The settling chambers 348 and 350 also comprise secondary combustion chambers where some combustion continues to take place, as discussed above in conjunction with FIGS. 1 and 2. The combustion gases, with the products of combustion, are also slowed down in the chambers 348 and 350 and accordingly some of the fly ash and other particles or residue of combustion settle out from the gases. It will be recalled, as discussed above in conjunction with FIGS. 1 and 3, that the ceramic smoke scrubbers or grids are heated by the combustion processes within the combustion chamber 330. The elevated temperature of the grids results in the combustion of some of the residue or the products of the original combustion from the combustion chambers 330 taking place in the grids during the flow of the gases or smoke and uncombusted particles and other residue of the original combustion during the flow of the gases through the grids. The secondary combustion continues in the chambers 348 and 350.

The gases, with some particulate matter, flow from the primary settling chambers 348 and 350 rearwardly through a pair of arches or passageways 352 and 354, respectively, into a secondary settling chamber 356. The gases, with particulate matter therein, are further slowed in the secondary settling chamber 356.

As best illustrated in FIG. 6, there is a double wall about the combustion chamber 330 for the enhancement of heat transfer. Parallel to the right combustion chamber wall 332 is a wall 360, and parallel to the left combustion chamber wall 334 is a wall 362. The walls 360 and 362 comprise outer combustion chamber walls, and they also comprise inner walls for the respective settling chambers 348 and 350, together with another pair of walls 370 and 372, which are substantially parallel to the walls 360 and 362, respectively. The walls 370 and 372 are spaced apart from, and parallel to, the outer walls 308 and 310, respectively. As shown in FIG. 7, the walls 332 and 360 and the walls 334 and 362 respectively comprise support walls for the grid shelves 340 and 342. The walls 332, 360, 334, and 362 extend between the secondary front wall 322 and the rear combustion chamber wall 336. Walls 370 and 372 extend from wall 322 to an inner rear wall 382.

Parallel to the rear combustion chamber wall 336 is an outer combustion chamber wall 380, which wall 380 comprises the forward or front wall of the secondary settling chamber 356. The wall 380, like the wall 336, extends between and is secured to the walls 370 and 372. Extending between the outer walls 308 and 310, and parallel to but spaced apart from the rear outer wall or back plate 312 is the inner rear wall 382. The wall 382, or a portion of it, as shown in FIG. 6, comprises the rear wall for the secondary settling chamber 356. The walls 370 and 372 are secured, at their back or rearmost portion, to the wall 382.

As noted in FIGS. 5, 6, and 7, the double walls around the combustion chamber and also around the chambers through which the combustion gases flow, provide a plurality of chambers, some for the passage or circulation of heated air and some for the passage of the products of combustion. The primary passages or chambers for the products of combustion have been discussed above, but only the plenum chamber 306, disposed beneath the combustion chamber and defined between the floor 304 of the combustion chamber and the bottom plate 302 has been discussed. From FIG. 5 is is noted that the plate 304, which comprises the floor of the combustion chamber 330, also comprises the floor for the secondary settling chamber 356 and also the floors for the primary settling chambers 348 and 350, the latter of which chambers are best shown in FIGS. 6 and 7. Moreover, as seen in FIGS. 5, 6, and 7, the plate 304 also comprises the bottom or floor for the plurality of chambers through which the heated air circulates about the combustion chamber 330, about the primary settling chambers 348 and 350, and about the secondary settling chamber 356.

Between the wall 332 and the wall 360 is a chamber 364, and between the wall 334 and the wall 362 is a chamber 366. The chambers 364 and 366 are closed at their respective front and rear ends by the inner or secondary front wall 322 (front combustion chamber wall) and the rear combustion chamber wall 336. A plurality of apertures 368 and 369 provide communication between chamber 390, which will be discussed below, and the chambers 364 and 366. The chamber 364 communicates with the plenum chamber 306 by a plurality of apertures 365 which extend through the floor or hearth plate 304. Similarly, a plurality of apertures 367 is cut through the floor plate 304 to allow the chamber 366 to communicate with the plenum chamber 306.

A plurality of fins 333 is secured to the wall 332 and extend into the chamber 364 for heat transfer purposes. Similarly, a plurality of fins 335 is secured to the wall 334 and extend into the chamber 366 for heat transfer purposes.

A chamber 374 is defined between the right outer wall or plate 308 and the wall 370, at the right side of the fireplace furnace apparatus 300, while chamber 376 is defined between the left outer wall of plate 310 and the wall 372. The chambers 374 and 376 communicate with the plenum chamber 306 by a plurality of apertures 375 and 377, respectively, which extends through the floor plate 304. A plurality of fins 371 is secured to the wall 370 and extends into the chamber 374 for heat transfer purposes. A plurality of fins 373 is secured to the wall 372 and extends into the chamber 376 for heat transfer purposes.

At the rear of the fireplace furnace apparatus is a chamber 384 which is defined by the rear outer wall or back plate 312, the inner rear wall 382, and the outer side plates 308 and 310, as best shown in FIG. 6. The chamber 384 communicates with the plenum chamber 306 by a plurality of apertures 318 which extend through the floor plate 304. The chambers 374 and 376 also communicate with the chamber 384 through a plurality of apertures 386 and 387 which extend through the wall 382, as best illustrated in FIGS. 6 and 7. A plurality of fins 383 extends into the chamber 384 from the wall 382 for heat transfer purposes.

A chamber 390 is defined by the rear wall 336 of the combustion chamber 330, the wall 380, and the walls 370 and 372. The pair of arches 352 and 354, as shown best in FIG. 7, extends through the chamber 390 to provide communication between the primary settling chambers 348 and 350 and the secondary settling chamber 356.

The arch 352 is defined by the bottom plate 304, a pair of side walls 394 and 395, as shown in FIG. 6, and a top plate 396, shown in phantom in FIG. 5. The arch 354 is similarly closed by a pair of plates 397 and 398, shown in FIG. 6, and a top plate, not shown, but substantially identical to the plate 395 shown in FIG. 5 for the arch 352. The arches 352 and 354 comprise passageways between the settling chambers, as discussed above, and are, of course, sealed from the chamber 390.

A plurality of apertures 368 and 369, extending through the wall or plate 336, as shown in FIGS. 6 and 7, allow respective communication for the chambers 364 and 366 with the chamber 390. A plurality of apertures 391, as best shown in FIG. 5, but as also illustrated in FIG. 6, allows communication between the chamber 374 and the chamber 390. Similarly, a plurality of apertures 392 extends through the wall 372 to provide communication between the chamber 376 and the chamber 390. As best shown in FIG. 6, but as also shown in FIG. 5, a plurality of apertures 393 extends through the floor plate 304 to provide communication between the chamber 390 and the plenum chamber 306.

Figure 23:
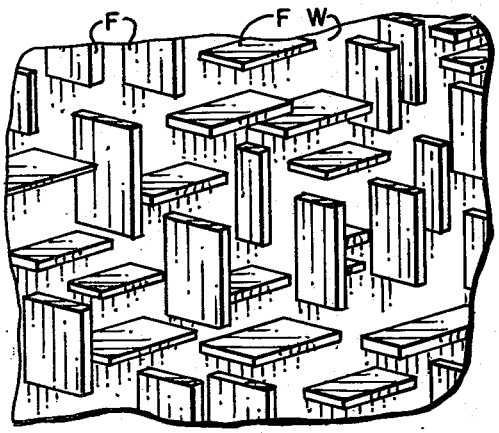
FIG. 23 is a perspective view illustrating the random orientation of fins in the apparatus of the present invention.

Within each of the chambers through which air passes or flows, and in which air is heated and circulated throughout the room or enclosure in which the furnace fireplace apparatus is disposed, is a plurality of fins, schematically illustrated or represented as extending outwardly into the respective chambers from the external sides of the walls of the combustinn chamber and the other chambers through which the hot combustion gases flow. The fins or plates are designated in each chamber by reference numerals, all as discussed. The purpose of the fins, obviously, is to enhance the transfer of heat from the fireplace furnace apparatus to the warm air flowing through the various chambers and outwardly into the room or enclosure. The illustrations in the Figures are schematic only, with FIG. 23 illustrating more nearly correct the employment and disposition of the fins.

At the front of the fireplace furnace apparatus is an opening 331 which provides access to the combustion chamber 330 for loading fuel into the combustion chamber. The opening 331 is defined by the front wall 320, the secondary front wall 322, and four plates, including top and bottom plates 324 and 326, as shown in FIG. 5, and side plates 325 and 327, as best shown in FIG. 6. About the opening 331, and defined by the front wall 320 and the secondary front wall 322 and the side walls 332 and 334, as shown in FIGS. 5 and 6, is a chamber 328. The chamber 328 communicates with the chambers 364 and 366 through a plurality of apertures 329 and 337 which extend through the wall 322. The chamber 328 also communicates with the chambers 374 and 376 through a plurality of apertures 378 and 379, respectively, which also extends through the wall 322. The chamber 328 also communicates with the plenum chamber 306 through a plurality of apertures 319 which extend through the floor 304, as shown in FIG. 5.

As shown in FIG. 5, the chamber 328 also includes a plurality of fins 323, extending into the chamber from the wall 322, as discussed above.

The opening 331 is closed by a pair of sliding doors 402 and 404 which are appropriately supported on the front wall 320 for lateral movement along the front wall 320. The support and construction of such doors is well known and understood. For example, the doors may be of hollow steel construction, filled with an insulative material, or they may merely be a steel sheel filled with insulative material, such as refractory material. Moreover, the doors may be disposed on a pair of tracks and may include overlapping flanges to insure that the opening 331 is well sealed to prevent the smoke and combustion gases and particulate matter from escaping from the combustion chamber into the room or enclosure in which the furnace fireplace apparatus is disposed.

Referring primarily to FIG. 5, it will be noted that the rear chamber 384, between the rear wall or plate 312 and the inner rear wall 382, extends upwardly beyond the horizontal wall or ceiling plate 338, which comprises the ceiling for the combustion chamber 330 and also the ceiling for the secondary settling chamber 356. Similarly, the walls 308 and 310 extend upwardly above the plate 338. The top of the furnace apparatus is closed by a top plate 410, which is preferably parallel to the bottom plate 302, the floor plate 304, and the plate 338.

At the forward end of the furnace fireplace apparatus, and extending above the plate 338 rearwardly of its front hot plate portion 339, is an upper front plate 412. The rear plate defines or constitutes the rear of the fireplace apparatus, the bottom plate 302 defines the bottom of the fireplace apparatus, and the top plate 410 defines the top of the fireplace furnace apparatus. The front of the fireplace furnace apparatus is divided or separated into three vertical portions, the lower front plate 314, the front wall 320, which supports the doors 402 and 404, and the upper front plate 412.

A chamber 420 is defined between the side walls 308 and 310, the rear wall 312, the front plate 412, the middle horizontal plate 338, and the top plate 410. Within the chamber 420, and extending between the inner side walls 370 and 372, and forwardly of the wall 382 above the plate 338, is a damper chamber 430. The damper chamber 430 is defined by a portion of the inner rear wall 382, a front wall 426, which extends upwardly from the middle plate 338, and by portions of the inner side walls 370 and 372. The top of the damper chamber 420 is closed by a top wall 428, which extends between the inner side walls 370 and 372, forwardly of the inner rear wall 382, and terminates at the chamber front wall 426.

The respective walls of the chamber 430, like the walls of the other chambers as heretofore discussed, and which comprise elements of the furnace fireplace apparatus 300, are preferably welded to secure the walls or plates together. This provides a substantially airtight construction so as to prevent direct contact between the various chambers in which the heated air flows and the various chambers in which the combustion gases flow.

As shown in FIGS. 5, 6, and 7, and as previously discussed, the heated air chambers include fins for heat transfer. Fins 333 and 361 in chamber 364, fins 335 and 363 in chamber 366, and fins 381 and 389 in chamber 390 have not been previously discussed. In chamber 420, fins 429 extend from the walls 426 and 428.

A generally elongated damper opening 432 extends through the middle horizontal plate 338 to provide communication between the secondary settling chamber 356 and the damper housing or damper chamber 430. A plate 434 extends upwardly and forwardly at an angle from the general vicinity of the juncture of the plate 338 with the wall 382. The plate 434 terminates generally above the opening 432 and it comprises a stop for a damper 436. The damper 436 is shown hingedly secured for pivotal movement on the middle plate 338 adjacent the opening 432, but remote from the plate 434, or on the opposite side of the opening 432 from the plate 434.

A damper actuation rod 438 is secured to the damper 436 and extends through the front damper chamber wall 426 and the apparatus front plate or upper front wall 412 to a damper actuating lever 440. The lever 440 is pivotally secured to the forward hot plate or shelf portion 339 of the middle plate 338. The actuating rod 438 may be disposed in a tube which extends between the wall 426 and the front plate 412, as shown. Other sealing means may also alternatively be used to prevent the flow of combustion gases from the chamber 430 to intermix with the heated air in chamber 420. Rod 438 is shown in tube 439 in FIG. 5.

As shown in FIG. 5, the damper 436 is disposed in an open position, but yet it is overlying the opening 432 so that the flow of combustion gases upwardly into the chamber 430 from the chamber 356, and from the chamber 430 upwardly into a chimney 442, is not in a direct line. Rather, the upward flow of the combustion gases into the chimney 442, through an opening 444 in the top wall 428 of the chamber 430, is in a circuitous path. This once again allows particulate matter to settle out of the gases in the chamber 430, which thus comprises a tertiary (third) settling chamber for particulate matter in the combustion gases.

To close the chamber 430 to the flow of gases from the chamber 356, the damper actuating lever 440 may be moved from the position shown in FIG. 5 rearwardly toward the front plate 412 to allow the damper 436 to pivot on the plate 338 towards the plate 434. When the damper 436 is fully closed, the damper 436 rests on the plate 434.

The chimney 442 is preferably welded to the top wall or plate 428 of the damper housing about the opening 444 to provide for an airtight connection between the chimney and the plate 428. This assumes, of course, that the chimney 442 is made of an appropriate metal, such as steel. Such is preferable to allow for the maximum transfer of heat from the combustion gases flowing upwardly through the chimney flue 442 to heated air being blown downwardly into the furnace fireplace apparatus through a chamber 416 which is defined between the chimney 442 and an outer stack 414. The chamber 416 communicates with the chamber 420 through an opening 418 in the top plate 410. It will be noted that the opening 418 is substantially larger in diameter than the outer diameter of the chimney 442. The chimney stack 442 also extends through the opening 418, and inwardly and upwardly through the chamber 416, within the outer stack 414. Fins 441 and plates 443 are secured to stack 442.

As illustrated above in conjunction with FIG. 4, a blower may be secured to the outer stack 414 to provide for the forced flow of air downwardly through the chamber 416, into the chamber 420, and from the chamber 420 into the chamber 384 through a plurality of apertures 446, and into the chambers 374 and 376 through other apertures, not shown, extending through the plate 338.

In order to clean out the settling chambers, appropriate cleanouts must be provided. The cleanouts may consist of tunnels or channels which extend through the walls of the furnace fireplace apparatus to the settling chambers. One such cleanout is shown schematically in FIG. 5 as cleanout 450 which communicates with the chamber 430. Obviously, the cleanout 450 must extend through the walls 308 and 370, or at least through the outer wall 308, if the chamber 430 extends to the wall 308, in order to provide access to the settling chamber 430.

Another cleanout 452, closed by an outer door 454, is shown in FIGS. 5 and 6 extending through the rear wall or back plate 312 and through the inner rear wall 382 to provide communication with both chambers 356 and 348. A cleanout 456, with its door 458, is also shown in FIG. 6 communicating with chambers 356 and 350. The cleanouts 452 and 456 are also illustrated in FIG. 7. If desired, one or two lateral cleanouts may be provided through the side walls to communicate with the settling chamber 356.

Referring again to FIG. 5, it will be noted that the rear wall or back plate 312 includes louvers 424, and the front plate 412 includes louvers 422. The louvers are provided in the respective walls to enhance the flow of air, if desired. For example, the louvers 422 may be opened to provide for the flow of air outwardly from the chamber 420 into the room or enclosure in which the fireplace furnace apparatus 300 is disposed. If the fireplace furnace apparatus 300 is disposed against or through a rear wall, the louvers 424 may be opened to provide, in conjunction with opened louvers 422, for the venting of air from the room or enclosure outwardly. In such case, an exhaust fan or blower B may be secured to the rear wall or plate 312 at the louvers 424 to provide for such exhaustion or venting of air. The louvers 422 may also be opened when the louvers 424 are opened to enhance the flow of air from the room or enclosure, through the apparatus, and outwardly. If the outer stack 414 is connected to a barometric damper, such as barometric damper 234 of FIG. 4, such damper would be closed in order to effectively exhaust air through the furnace fireplace apparatus through the louvers 424 from the room or enclosure in which the apparatus is located.

The louvers or dampered louvers 422 and 424 may be opened during an electrical power outage. The natural convective flow of heat out of the apparatus 300 through the louvers may prevent an accumulation of heat which might otherwise occur.

To enhance the burning of exotic fuels within the combustion chamber 330, a supply of pressurized air is provided into the combustion chamber through an air pipe 460, shown in FIG. 5 and in more detail in FIG. 8. The air pipe 460 is shielded by a plate 466. FIG. 8 is a perspective view of a portion of the combustion chamber 330 illustrating the orientation of the air pipe 460 and its shield 466. For clarity, the pipe 460 and its plate 466 have been omitted from FIG. 6.

In FIG. 8, the right combustion chamber 32 is shown, and secured to the wall 332 is the secondary front wall 322, and both the side and front walls are secured to the floor plate 304. The air pipe 460 extends into the combustion chamber 330 through the wall 332 and is preferably loosely secured to the wall 322. The term "loosely" simply denotes that the pipe 460 may be rotated about its longitudinal axis, but is preferably secured so that it cannot move along its longitudinal axis.

The plate 466 is shown disposed at an angle between the floor 304 and the wall 322 and the pipe is disposed beneath the plate, so that the plate shields the pipe from the combustible materials within the combustion chamber 330. The plate 466 includes a plurality of elongated slots 468 which register with a plurality of holes 464 in the pipe 460. The distal end of the air pipe 460 is closed by a weld 462, preferably adjacent the combustion chamber wall opposite from where the pipe enters the combustion chamber. The pipe accordingly extends completely across the combustion chamber. If desired, plate 466 could be replaced by a pipe.

With the holes or apertures 464 of the pipe 460 aligned with the slots 468, the pipe 460 may be rotated so as to direct the flow of compressed air out of the pipe 460 and through the holes 464 over a relatively wide angular or arcuate distance into the firebox or combustion chamber 330. Thus, depending on the type of material to be combusted within the combustion chamber, and the height of such material, the air pipe 460 may be aimed to direct its flow of compressed air into the combustion chamber in an orientation so as to provide maximum efficiency with respect to the fuel and the combustion taking place within the combustion chamber. The length of the slots 468, and the location on the wall 322 on which pipe 460 is secured, allows the air from the holes 464 to be directed substantially horizontally, or even slightly below horizontally, or upwardly, as desired by the user and in accordance with rotation of the air pipe 460. While the pipe 460 is shown disposed low in the chamber, adjacent the floor 304, it may be placed higher on the wall 322, if desired. Moreover, a second air pipe may be used, also, depending on the type of fuel to be used. For example, some exotic fuels such as rubber dust, require more air (or oxygen) for improved combustion. In such case it may be well to use two air pipes, one relatively low, as in FIGS. 5 and 8, and a second pipe disposed higher in the combustion chamber, such as shown in FIG. 20. Further, an electric eye across a chimney flue to sense the presence of smoke in the combustion gases, well known in the art, may be used to control a solenoid for the second air pipe. If desired, the second air pipe may be connected to a pressurized gas supply richer in oxygen than ordinary air.

The holes 464 are relatively small and are, of course, preferably drilled radially through the wall of the pipe 460. The pressure of the compressed air emanating from the holes 464 is sufficient to keep the holes clean and free from soot, and the like. Moreover, the air flow is also sufficient to keep the slots 468 relatively clean. The holes or jets in stainless steel pipe seem to remain cleaner and more free from soot than holes in iron pipe. Accordingly, the use of stainless steel pipe is recommended. The provision of the compressed air, as heretofore discussed, allows for the combustion of material such as newspaper, magazines, and the like, in their ordinary, layered, or flat configuration as they are normally stacked. That is, it is not necessary to take newspapers and to remove the pages and crumble individual pages into balls in order to provide air space for combustion, or to roll them into "logs". Rather, the provision of the compressed air is sufficient to provide oxygen requirements for the burning of such dense materials as newspapers, magazines, and exotic fuels of various types, such as heretofore discussed.

The holes 464 are shown spaced apart a substantial distance and aligned radially. However, it is obvious that the holes or orifices 464 may be spaced closer together and may be randomly oriented about the pipe for dispersed entry of compressed air into the combustion chamber. The smaller the hole, generally speaking, the greater the pressure of compressed air through each individual hole, and the greater the penetration of the air into the combustion chamber.

While the air pipe 460 is shown in FIG. 8 as extending across the front of the combustion chamber, it is also obvious that the compressed air pipe may run longitudinally of the combustion chamber from front to back, or substantially perpendicular to that shown in FIG. 8, as shown in FIG. 20. For relatively large combustion chambers, air jets on each side of a combustion chamber are desirable.

The pipe 460 and plate 466 have been omitted from FIG. 6 for clarity purposes, and are thus shown enlarged in FIG. 8. FIG. 8 also shows a pipe guide or sleeve 470 through which the pipe 460 extends. The sleeve 470 is appropriately welded to walls 332, 360, 370, and 308 for sealing purposes.

Figure 9:
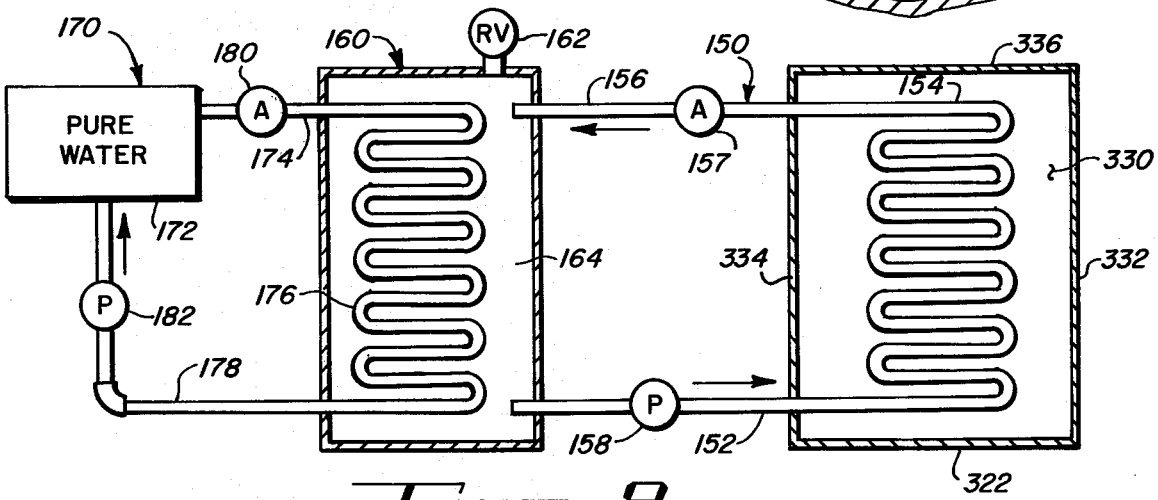
FIG. 9 is a schematic diagram illustrating the application of the apparatus of the present invention to the heating of water.

FIG. 9 is a schematic diagram of a water heating system usable with the apparatus of the present invention. The water supply system includes a conventional hot water coil or water leg disposed in the fire box of a fireplace furnace apparatus, with a storage tank for heated water, and a separate coil system connected to a pure water supply for domestic use.

In FIG. 9 is illustrated the fire box 330, discussed above, with its walls 322, 332, 334, and 336. A hot water circuit 150 includes a water supply pipe 152 connected to coils 154 disposed within the combustion chamber 330. An outlet pipe 156 is also secured to the coils 154. Both the supply pipe and the outlet pipe, secured to the coils 154, extend to a heat storage tank 160. A pressure relief valve 162 is schematically illustrated as secured to the storage tank 160 and communicating with a chamber 164 which comprises the interior of the tank 160. A fluid medium, such as water or mineral oil, may be disposed within the tank 164 and is accordingly in communication with the supply pipe 152 and the outlet pipe 156. The fluid medium circulated through the coils 154 in the combustion chamber 330 may be most typically water, but may also be any other fluid or liquid, such as mineral oil, if desired.

In the outlet pipe 156 is an aquastat 157 which controls a pump 158 located in the supply pipe 152. It will be noted that the terms "supply" and "outlet" refer to the direction of flow of fluid, such as water, through the coils 154.

When the temperature of the fluid in the outlet pipe 156 decreases to a certain, predetermined, value, as sensed by the aquastat 157, the aquastat turns on the pump 158 which causes the flow of fluid in the pipe 152, the coil 154, and the pipe 156, to commence. Again, when the temperature of the circulating fluid reaches a predetermined value, the aquastat 157 will turn off the pump 158. The circulation of the fluid in the hot circuit 150 is dependent upon the predetermined temperature values preset into the aquastat. In turn, the aquastat controls the pump 158.

Within the storage tank 160 is a liquid heat storage medium, such as water, the temperature of which rises and falls in accordance with the circulation of the liquid heated by circulation through the combustion chamber. The temperature of the liquid medium also varies in accordance with the hot water demands of a pure water system 170. Included in the pure water system 170 is a hot water tank 172, a water outlet pipe 174, coil 176, and water inlet pipe 178. The outlet pipe 174 extends from the tank 172 to the coil or coils 176 disposed within the heat storage tank 160. The inlet pipe 178 extends from the coils 176 to the tank 170. The tank 172 is also connected to the domestic hot water supply in the home or building in which the apparatus is located, not shown.

Circulation of the water through the coils 176 is controlled by an aquastat 180 and a pump 182. The aquastat 180 is located in the outlet pipe 174 between the water tank 172 and the coils 176, and the pump 182 is located in the water inlet pipe 178 which extends from the coils 176 to the tank 172. The aquastat 180 and pump 182 work substantially the same as, but independently of, the aquastat 157 and pump 158 in the hot water or liquid circuit 150. Upon sensing a predetermined low temperature, the aquastat 180 causes the pump 182 to turn on. The pump remains on until the temperature of the water drops below the setting of the aquastat.

It will be noted that the heat storage tank 160 is able to provide hot water for domestic and other heating purposes from the tank 170 in a substantially more efficient and constant manner than the hot water coil systems in common usage with furnaces of the prior art.

Figure 10:
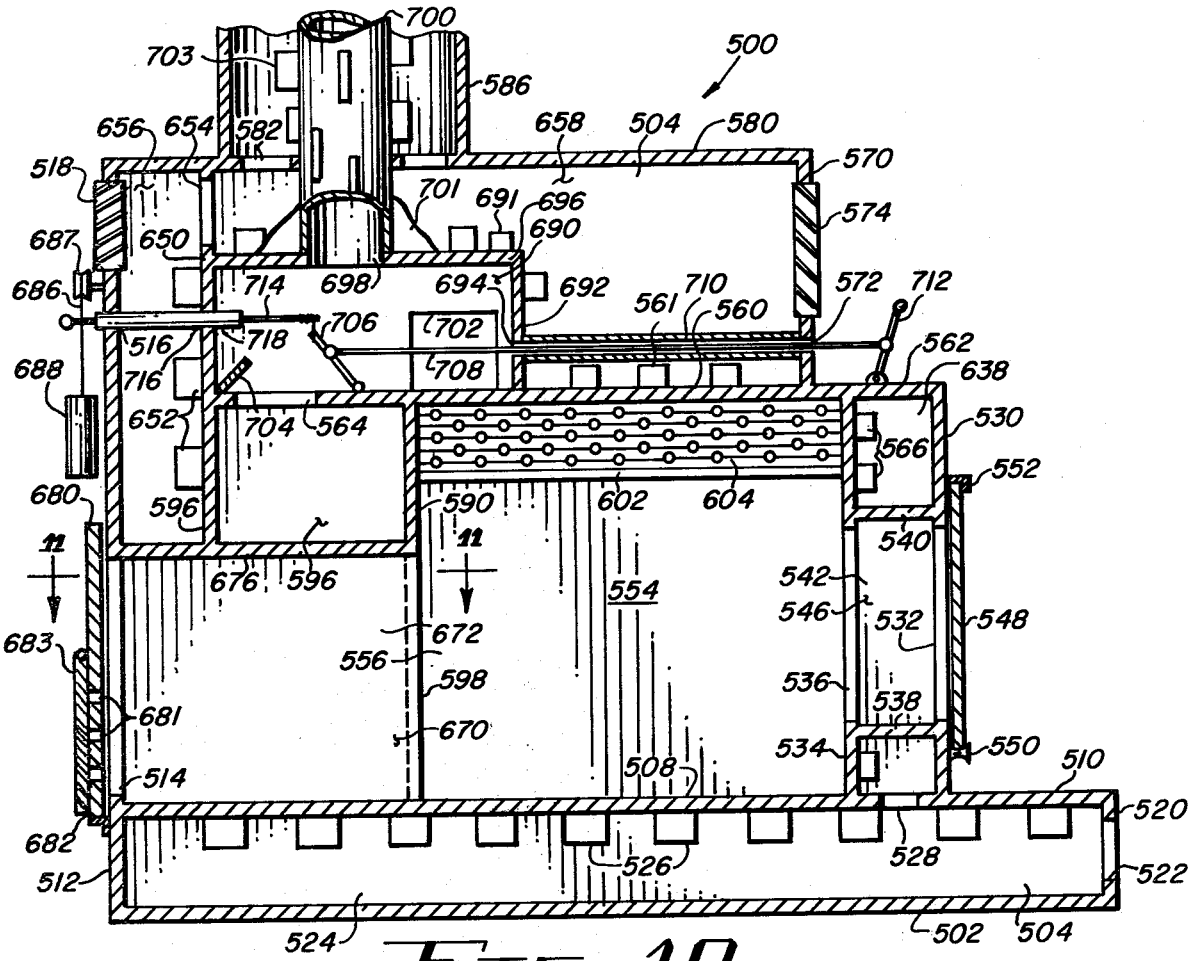
FIG. 10 is a view in partial section of an alternate embodiment of furnace fireplace apparatus of the present invention.
Figure 11:
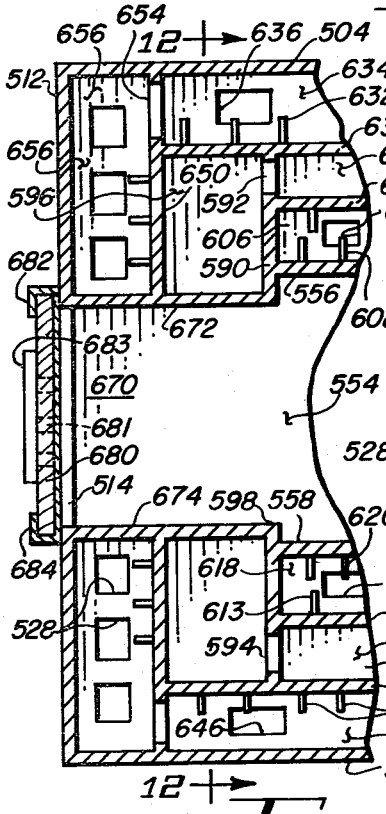
FIG. 11 is a view in partial section of a portion of the apparatus of FIG. 10 taken generally along line 11—11 of FIG. 10.
Figure 12:
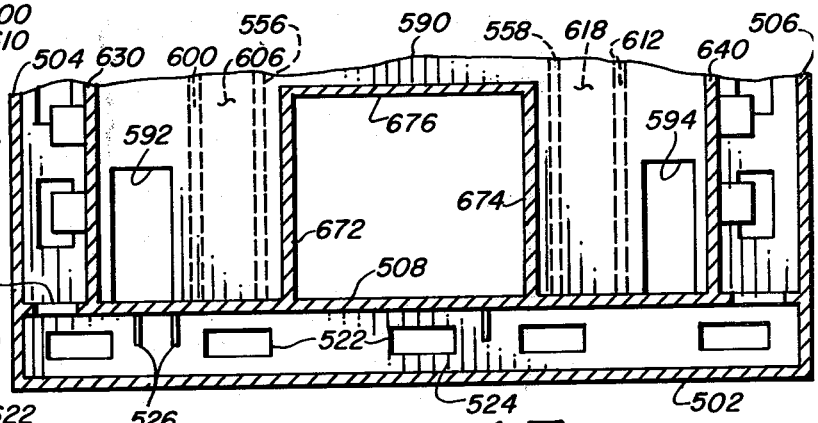
FIG. 12 is a view in partial section of a portion of the apparatus of FIGS. 10 and 11 taken generally along line 12—12 of FIG. 11.

FIG. 10 comprises a view in partial section through the approximate center line of an alternate embodiment of the furnace fireplace apparatus illustrated in FIGS. 5–7. FIG. 11 is a view in partial section of a view of the apparatus of FIG. 10 taken generally along line 11—11 of FIG. 10. FIG. 12 is a view in partial section of the apparatus of FIGS. 10 and 11 taken generally along line 12—12 of FIG. 11. In the description of the furnace fireplace apparatus 500 of FIGS. 10, 11, and 12, reference will be made to all three Figures.

Fireplace furnace apparatus 500 of FIGS. 10, 11, and 12 comprises an alternate embodiment of the fireplace furnace apparatus described above, and illustrated primarily in FIGS. 1, 3, 5, and 6. The apparatus 500 is designed with provisions for inserting the apparatus against and through a wall of a structure, with provisions for loading the apparatus, or the firebox of the apparatus, from both the front and the rear of the apparatus. Provisions are also made for venting the fireplace furnace apparatus to remove heat from the apparatus, and even from the structure in which the apparatus is disposed. These features will be discussed in detail in conjunction with the embodiment of FIGS. 10. 11, and 12.

Beginning at the bottom of the apparatus, the fireplace furnace apparatus 500 includes a bottom plate 502, and appropriately secured on the respective right and left sides of the bottom plate 502 are a pair of side plates 504 and 506. The side plates 504 and 506 extend upwardly substantially perpendicular to the bottom plate 502. As with the apparatus of the previous embodiments, as discussed above, the various plates comprising floors, walls, and the like, are appropriately secured together, as by welding.

Spaced above the bottom plate 502 and extending between the right and left side walls 504 and 506, respectively, is a floor plate 508. The floor plate 508 comprises the floor for the firebox of the apparatus, as will be discussed in detail below. A forward portion of the floor plate 508 comprises a front apron or hearth portion 510.

The back or rear of the fireplace furnace apparatus includes a back plate 512, which is appropriately secured to the bottom plate, the floor plate, and the side plates. The back plate 512 includes an opening 514 which defines a rear door opening. Above the rear door opening 514 is an aperture 516 through which extends a rod 714 for activating the damper, as will be discussed below. Above the aperture 516 and secured to an opening in the back plate 512 are dampered and adjustable louvers 518. Their use for venting purposes will also be discussed below.

At the lower front of the furnace fireplace apparatus 500 is a lower front panel 520 which is secured to the bottom plate 502, the side plates 504 and 506, and to the front apron or hearth portion 510 of the floor plate 508. A plurality of apertures 522 extend through the lower front plate or panel 520. A plenum chamber 524 is defined between the bottom plate 502, the floor plate 508, the right and left sides 504 and 506, the back plate 512, and the lower front plate 520. Extending into the chamber 524 and secured to the floor plate 508 are a plurality of fins 526. The purpose of the fins 526 is substantially the same as the purpose of the fins 398, shown best in FIGS. 5 and 7. That is, the fins 526 comprise elements for radiating heat into the plenum chamber 526, and thus serve as heat exchangers for the air flowing through the chamber 524 and outwardly through the openings 522 into the room or structure in which the furnace fireplace apparatus 500 is located. The fins 526 are shown in FIG. 10 as being in substantially an aligned and regular orientation. However, as has been mentioned above, the orientation of the fins may be, and preferably is, irregular so as to maximize the heat transfer from the fins to the air by requiring the air to flow in a serpentine fashion against and around the fins, as shown in FIG. 23. The air, thus traveling in an elongated path, is heated to a maximum practical temperature.

Above the apron 510 is a metal front wall or plate 530, which extends between the right and left side walls 504 and 506, respectively, and up to a middle plate 560. The middleplate 560 comprises a top or ceiling for the combustion chamber of the fireplace furnace apparatus. The middle plate 560 includes a forward portion 562 which defines a front shelf. In the rear portion of the middle plate 560 is an aperture 564 which provides the passage for smoke to flow upwardly to a damper chamber 690, as will be discussed below.

Extending between the floor plate 508 and the middle plate 560, and substantially parallel to the middle front panel 530, but spaced apart from the plate or panel 530, is a wall 534 which comprises the front wall of the firebox for the furnace fireplace apparatus 500. The wall 534 includes an opening 536 which is substantially the same size, and parallel to, a door opening 532 which extends through the front plate 530. The openings 532 and 536 provide access into the firebox to allow for the insertion of fuel into the firebox and for the removal of ashes, and the like, therefrom. Between the openings 532 and 536 is a passageway 546 which is closed on the bottom by a plate 538, on the top by a plate 540, by a pair of passage walls, only one of which, right passage wall 542, is shown in FIG. 10. The left passage wall is not shown in the drawing. The passage 546 is closed by a pair of sliding doors 548 which roll on bottom rollers 550 and within a top guide 552. The sliding doors 548 slide sideways to allow full access to the passageway 546. Most probably the passageway 546 will receive only minimal use, with rear loading and cleaning being preferred, as discussed below. A masonry partition may be added to the front of the apparatus 500 for aesthetic purposes. The doors 548, when opened, slide into the masonry partition.

Extending upwardly from a middle plate 560 is an upper front plate 570. An aperture 572 extends through the upper front plate 570 and a rod 708 for actuating the damper extends through the aperture 572 in a guide 710. Adjustable louvers 574 also extend through and are secured to the upper front plate 570. The purpose of the louvers 574, like the louvers 518, will be discussed below.

The top of the fireplace furnace apparatus is closed by a top plate 580. The top plate 580 extends between the sides 504 and 506 and is appropriately secured to the back plate 512 and to the upper front plate 570. The top plate 580 includes an aperture 582 through which extends an inner stack or chimney flue 700 for transporting smoke, flue gas, and the like, away from the fireplace furnace apparatus.

A combustion chamber 554 extends between the front firebox wall 534, a rear firebox wall 590, and a pair of side walls 556 and 558. The side wall 556 comprises the right side, and the side wall 558 comprises the left side, walls of combustion chamber 554. The top of the firebox 554 is the middle plate 560, and the bottom of the firebox is the floor plate 508.

Above the combustion chamber 554 is a chamber 658, which extends between the top plate 580, the middle plate 560, and between the upper front plate 570 and the inner rear wall 650.

Spaced apart from the right firebox wall 556 is a wall 600. The wall 600 is substantially parallel to the wall 556 and it, together with the wall 556, comprises a pair of supports for a grid shelf 602. Between the grid shelf 602 and the middle or intermediate plate 560 are a plurality of smoke grids or smoke scrubbers 604. The walls 556 and 600 extend upwardly from the floor plate 508 to which they are secured, to the grid shelf 602. The grid shelf 602 in turn extends from the rear firebox wall 590 to the front firebox wall 534. Between the floor plate 508, the grid shelf 602, the walls 556 and 600, and the respective front and rear walls 534 and 590, is an intermediate chamber 606, as best shown in FIG. 11. Within the chamber 606 are a plurality of fins 608 which are secured to the wall 556. The fins serve to radiate heat from the firebox 554 and the wall 556 into the chamber 606 and thus act as heat exchangers for air flowing through the chamber 606. Communication between the chamber 606 and the bottom or plenum chamber 524 is through a plurality of apertures 610.

On the left side of the combustion chamber 554, as best shown in FIG. 11, and spaced apart from the left combustion chamber wall 558, is a wall 612. The walls 558 and 612 support another grid shelf, not shown, but substantially like the grid shelf 602 shown in FIG. 10. A plurality of grids, also not shown, extend between the grid shelf and the middle plate 560. Between the walls 558 and 612, and above the floor 508 and extending upwardly to the second grid shelf, and between the walls 534 and 590, is a chamber 618 which is substantially identical to the chamber 606. A plurality of fins 620 extend into the chamber 618 from the wall 558. Communication between the chamber 618 and the chamber 524 is through a plurality of apertures 622.

Spaced apart from the rear wall 512 is an inner rear wall 650. The wall 650 is substantially parallel to the wall 512 but spaced apart from the wall to define a rear chamber 656. A plurality of fins 652 extend into the chamber 656 from the wall 650. The fins serve substantially the same function as the fins heretofore discussed in conjunction with the various embodiments of the apparatus of the present invention. A plurality of apertures 654 extend through the wall 650 to communicate with adjacent chambers, such as the chambers 634 and 644 as shown in FIG. 11, and also with an upper chamber 658, as shown in FIG. 10.

A right side intermediate wall 630 extends between the inner rear wall 650 and the inner front wall 534 longitudinally of the fireplace furnace apparatus 500, and between the middle plate 560 and the floor plate 508. The wall 630 is spaced apart from the outer wall 504 to which it is parallel. A similar left side intermediate wall 640 also extends from the inner rear wall 650 to the inner front wall 634 substantially parallel to the left side wall 506. The wall 640 extends vertically between the plate 508 and the plate 560. A plurality of fins 632 are secured to the walls 630 and extend into a chamber 634 defined between the right outer wall 504 and the intermediate wall 630, the rear intermediate wall 650, and the intermediate front wall 534. The fins 632 serve substantially the same purpose as heretofore discussed with respect to the other fins. A plurality of apertures 636 extends through the floor 508 to provide communication between the chamber 634 and the bottom plenum chamber 524.

A chamber 644, substantially identical to the chamber 634, is defined within the walls 506, 640, 650, and 534, and the floor plate 508 and the middle plate 560. A plurality of fins 642, secured to the wall 640, extends into the chamber 644. A plurality of apertures 646 extending through the floor 508 provides communication between the chamber 644 and the plenum chamber 524.

A primary settling chamber 660 is defined between the wall 600, the wall 630, the front firebox wall 534, and the rear firebox wall 590. A similar primary settling chamber 664 is defined between the walls 612 and 640, the front firebox wall 534, and the rear firebox wall 590. The settling chambers 660 and 664 communicate with the firebox 554 through the grids, such as the grids 604 shown in FIG. 10.

As fuel is combusted in the firebox 554, the products of combustion rise to the top of the firebox and flow through the grids 604 into the settling chamber 660. Products of combustion also flow through another set of grids, not shown, substantially the same as the grids 604, and into the settling chamber 664. As has been discussed in conjunction with the embodiment of FIGS. 1–7 above, the elevated temperatures of the grids 602 result in additional combustion of the smoke and odors and other substances which have been incompletely combusted within the combustion chamber 554. This results in substantially cleaner burning and, ultimately, fewer particles or particulate matter resulting from the combustion processes which flow out of the firebox furnace apparatus and into the chimney flue 700.

After the combustion gases, with some particulate matter, flow through the grids, the flow of gases decreases in velocity in the respective settling chambers 660 and 664, thus allowing fly ash and other particulate matter to settle out of the gases and onto the floor of the settling chambers, which floor comprises a portion of the floor plates 508. The settling chambers may also be referred to as secondary combustion chambers, since combustion may continue in the chambers resulting from the flow of the gases through the hot grids.

From the settling chambers 660 and 664, the combustion gases flow into a secondary settling chamber 596, which extends between, or is defined by, the rear firebox wall 590 and the inner rear wall 650. Communication between the chamber 660 and the chamber 596 is by way of an arch 592 which extends through the rear combustion chamber wall 590, upwardly from the plate 508. A similar arch or aperture 594 extends through the wall 590 to provide communication between the settling chamber 664 and the secondary settling chamber 596.

Communicating with the firebox 554 through the rear or back plate or wall 512 is a rear loading tunnel or passageway 670. The passageway 670 communicates with the firebox through an opening 598 in the rear firebox wall 590 and through an opening 514 in the wall 512. The passageway 670 includes a pair of side walls 672 and 674, a top wall 676, and a portion of the floor plate 508. The top wall 676 of the loading tunnel or passageway 670 defines an upper portion of the floor of the secondary settling chamber 596, which chamber extends above and on each side of the passageway 664, as can best be seen in FIGS. 10 and 11.

A guillotine door 680 covers the opening 514 which extends through the rear wall 512 into the passageway 670. The guillotine door 680 moves vertically in a pair of guides 682 and 684. As shown in FIG. 10, a counterweight 688 is connected to the guillotine door 680 by a cable 686. The counterweight serves to easily allow the door 680 to be raised and lowered as desired. The cable 686 extends over appropriate pulleys, such as pulley 687, between the door 680 and the counterweight 688.

The rear loading for the firebox 554, through the passageway 670, allows the fireplace furnace apparatus 500 to be located on or through an exterior wall of a home or building, or adjacent a utility room, or the like, and thus makes it possible to eliminate the problems of bringing fuel into the house for loading into the firebox. Outside the structure, fuels of various types, including exotic fuels, as discussed above, may be stacked or disposed adjacent the rear of the apparatus 500 to facilitate direct loading to the passageway 670. Moreover, the passageway 670 allows the firebox to be cleaned from the rear, rather than through the front passageway 546.

To prevent "puff-back" from the firebox, which comprises miniature explosions caused by lack of oxygen, a plurality of apertures 681 extend through the door 680. A cover 683 is hingedly connected to the door 680 to cover the apertures 683. When the room thermostat is satisfied, compressed air is turned off and the fire in the firebox or combustion chamber goes to sleep. However, the rather abrupt cessation of air (oxygen) to the fire can result in "puff-back". The provision of the apertures 681 prevents "puff-back" but does not provide sufficient air to continue complete combustion. The fire accordingly dies down, as it is supposed to do, without the problem of "puff-back". The amount of air flowing through the apertures 681 depends on the position of the cover 683, which must be appropriately positioned.

As is well known and understood, both the front passageway 546 and the rear passageway 670 are centrally located, widthwise, of the apparatus 500. This is shown in FIGS. 11 and 12.

The upper portion of the secondary settling chamber 596 communicates with a tertiary settling chamber 690 through the aperture 564 in the middle plate 560, rearwardly of the rear wall 590 of the combustion chamber 554. The aperture 564 is preferably centrally disposed with respect to the apparatus widthwise. The tertiary settling chamber 690 is defined by a front wall 692, which extends upwardly from the plate 560 within the upper chamber 658, the inner rear wall 650, and a top wall 696. The top wall 696 extends laterally between the outer walls 504 and 506. An aperture 698 extends through the top wall 696 to provide communication between the chamber 690 and a chimney flue 700. The gaseous products of combustion flow out of the fireplace furnace apparatus 500 through the chimney flue 700. The chimney flue 700 is appropriately secured to the top wall or plate 696, as by welding, to provide an air-tight engagement therebetween. This prevents the products of combustion flowing into the chamber 690, and upwardly through the chimney flue 700, from escaping into the outer shell of the fireplace furnace apparatus, such as into the chamber 658, through which the heated air flows, and ultimately transferring into the room or structure in which the apparatus is located.

A plurality of fins or gussets 701 is secured to the chimney flue 700 and to the plate 696, as by welding. The fins or gussets provide structural support for the chimney flue and also help to dissipate heat by conducting heat away from the chimney. In addition to increasing the efficiency of the apparatus 500, the fins provide the functions of structural strength and heat dissipation to prevent burning of the steel chimney stack 700. Heat is concentrated in the area of the juncture of the stack to the damper housing roof. Fins 703 are also secured to the stack or flue 700. The fins 701 and 703 conduct away the heat and transfer the heat to the air flowing through the outer stack 586 and the aperture 582, and thence downwardly.

The diameter of the aperture 698 is preferably about the same as the inside diameter of the chimney flue 700. The chimney flue 700 extends through the aperture 582 in the top plate 580, and the aperture 582 is substantially larger than the outer diameter of the chimney flue 700. This allows substantially unrestricted flow of air through an outer stack 586, which is disposed concentrically outside of the chimney flue 700, and into the chamber 658. The flow of air preferably is downwardly between the chimney flue 700 and the outer stack 586, into the chamber 658, and thence downwardly, through chamber 656, and chambers 634 and 644, into the plenum chamber 524, and ultimately into the room or structure in which the apparatus is disposed through the apertures 522.

As discussed above, a blower or fan is preferably used in conjunction with the outer stack 586 to cause the air to flow downwardly through the stack 586, and through the various chambers of the fireplace furnace apparatus for ultimate distribution into the room or structure in which the fireplace furnace apparatus 500 is located. If desired, the louvers 574 may be opened to allow heated air to flow directly into the room or structure 658.

For a reverse flow, that is, to evacuate air from the room or structure in which the fireplace apparatus is located, the louvers 574 and 518 may be opened, and, with a blower or fan connected to the louvers 518, as shown in FIG. 5, air may be drawn from the room or structure, into the chamber 658 through the louvers 574, through a plurality of apertures 654 from the chamber 658 into the chamber 656, and from the chamber 656 outwardly through the louvers 518. Such reverse flow may be used in warm weather when heating is not necessary, but when the fireplace furnace apparatus of the present invention is used to provide hot water, as discussed above in conjunction with the fireplace furnace apparatus of FIGS. 1 through 9. If desired, the heated air exhausted through louvers 518 may be ducted to a stone bin or other heat storage area.

An appropriate cleanout 702 is provided for removing fly ash, and other particulate matter, from the chamber 690. The cleanout 702 extends through the outer wall 504 into the chamber 690.

Within the chamber 690, a plate 704 extends upwardly and forwardly from about the juncture of the intermediate plate 560 and the rear intermediate wall 650 partially over the aperture 564. The plate 704 is appropriately secured in place, as by welding. The plate 704 prevents the gaseous products of combustion from flowing directly upwardly through the chamber 690, and instead causes them to flow through the chamber 690 in a more circuitous manner. The plate 704 also comprises a stop against which a damper 706 is disposed when the damper 706 is in its full closed position.

The damper 706 is pivotally secured to the intermediate plate 560 within the chamber 690 and it is moved by appropriate mechanical linkage. A rod 708 is connected to the damper 706 and it extends through an aperture 694 in the wall 692, and through an appropriate guide 710 secured to the wall 692 and disposed about the aperture 694 and through the aperture 572 in the upper front wall 570 to a handle 712. The guide or tube 710 extends between and is secured to both walls 570 and 692 to prevent the intermixing of heated air with the combustion air, including the gaseous products of combustion and particulate matter, which are flowing in the respective chambers 658 and 690. The aperture 572 is appropriately insulated about rod 708 to prevent unwanted air or gas flow. The handle 712 is appropriately pivotally secured to the hot plate or apron portion 562 of the intermediate plate 560. Movement of the handle or lever 712 results in movement of the damper 706. The handle 712 accordingly allows the damper 706 to be positioned from within the structure or room in which the fireplace furnace apparatus is disposed.

A second rod 714 extends through an aperture 716 in the wall 650, and through an aperture 516 in the rear wall 512, and terminates exteriorally at the rear of the fireplace furnace apparatus 500.

An appropriate guide, such as pipe or tube 718, is disposed about the rod 714. The pipe or tube 718 is secured to the walls 512 and 650 about the apertures 516 and 716, respectively, to prevent the intermixing of the heated air flowing in chamber 656 from the combustion air in the chamber 690. The tube 716 about the rod 714 is also appropriately insulated to prevent unwanted air or gas flow. The rod 714 allows the damper 706 to be moved or adjusted from the back or rear of the fireplace furnace apparatus 500, just as the rod 708 allows the damper to be moved from the front of the fireplace apparatus.

The exterior of the damper chamber 690 includes a plurality of fins 691. The fins 691 are secured to the plates 696 and 692 and they extend into the chamber 658. Another plurality of fins 561 extend into the chambers 658 from plate 560. The purpose of the fins 561 and 691 is the same as has been adequately discussed heretofore.

The passage 546, illustrated in FIG. 10, comprises the opening for loading fuel into the firebox 554 from the front of the fireplace furnace apparatus. As discussed above, the passage 546 is defined by four walls which comprise the bottom, the top, and the sides of the passage. The passage is disposed within the chamber 638. The chamber 638 is a generally rectangular chamber defined between the floor plate 508, the intermediate or middle plate 560, the outer walls 504 and 506, the middle front wall 530, and the front firebox wall 534. The chamber 638 communicates with the chambers 634 and 644 through a plurality of apertures in the wall 534, such as aperture 535 shown in FIG. 14, and, through a plurality of apertures 528, with the plenum chamber 524. A plurality of fins 566 extend into the chamber 638 from the front firebox wall 534.

Thus, it will be seen that there are double walls about the entire firebox 554 and about the chambers disposed about the firebox 554 through which the gaseous and particulate products of combustion flow from the firebox 554.

Figure 13:
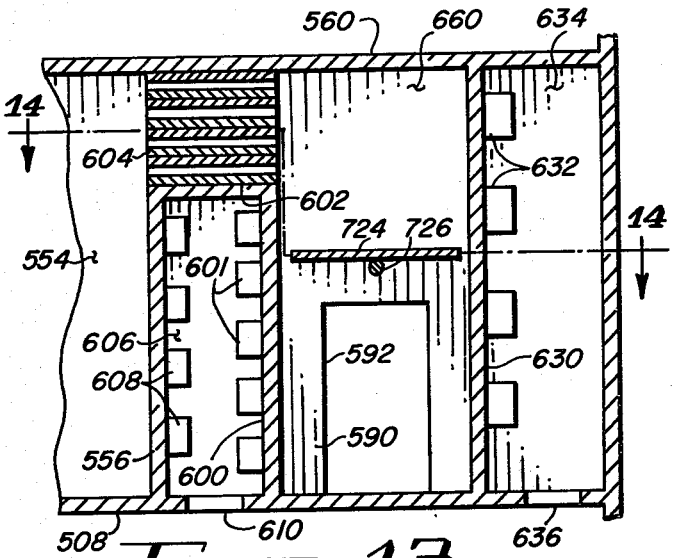
FIG. 13 is a view in partial section of a portion of the apparatus of FIGS. 10, 11, and 12.
Figure 14:
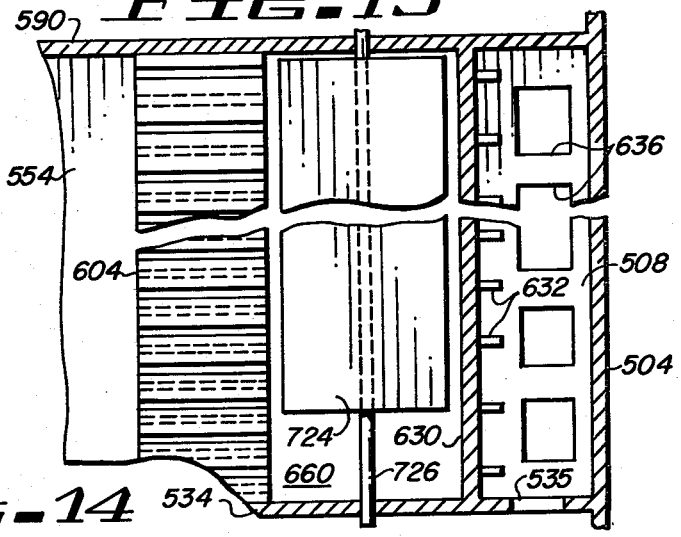
FIG. 14 is a view in partial section of the apparatus of FIG. 13 taken generally along lines 14—14 of FIG. 13.

FIG. 13 is a view in partial section of a portion of the apparatus of FIGS. 10, 11, and 12, illustrating the use of a damper in a settling chamber to lengthen the travel of the flow of combustion gases flowing from the combustion chamber 554, through the grid 604, and into the settling chamber 660. FIG. 14 is a view in partial section of the apparatus of FIG. 13 taken generally along lines 14—14 of FIG. 13. The two Figures will be discussed jointly, and accordingly reference will be made to both Figures .

A damper or valve 724 is shown disposed in the settling chamber 660 secured to a horizontally extending rod 726. The rod 726 is appropriately journaled for rotation in the rear firebox wall 590 and in the front firebox wall 534. The rod 726 continues through the front firebox wall 534, through the chamber 638, best shown in FIG. 10, and through the middle front wall 530 of the fireplace furnace apparatus 500, where an appropriate crank is secured to the rod for rotating the rod, and accordingly positioning the vane 724 secured to the rod.

The vane or damper 724, when disposed substantially horizontally as shown in FIG. 13, extends nearly the entire width of the chamber 660 between the walls 600 and 630. However, with respect to the length of the damper or vane 724, as may be seen in FIG. 14, the vane or damper is preferably less in length than the length of the chamber 660, and may generally be from about two-thirds to three-fourths of the length of the chamber. The front portion of the chamber 660 is accordingly not occupied by the vane, while the middle and rear portions of the chamber are occupied by the vane. That is, the vane begins adjacent the rear wall 590, but does not extend all the way to the front wall 534. Rather, there is a substantial space or gap between the front edge or portion of the vane 724 and the wall 534 which allows the gaseous products of combustion flowing through the grid 604 to move forwardly in the chamber 660, downwardly past the vane, and rearwardly again in the lower part of the chamber to the aperture or arch 592. By varying the angular orientation of the damper 724 in the chamber 660, by rotating the rod 726, the length of travel of the gases flowing into the chamber 660 from the grids 604 may be varied, as desired.

Referring again to FIG. 13, it will be noted that the grids 604, which extend between the grid shelf 602 and the intermediate plate 560, are located above the damper 724. The rod 726, which is secured to the damper 724, is located a sufficient distance below the grid shelf 602, and accordingly below the grids 604, so that rotation of the rod 726, which results in rotation of the vane 724, does not interfere with the flow of combustion gases and particulate matter through the grids 604. That is, regardless of the orientation of the damper or vane 724, the flow of gases and particulate matter through the grid 604 into the chamber 660 from the combustion chamber 554 is unimpeded. Rather, the gases and particulate matter flow into the upper portion of the chamber 660 and thence downwardly in the chamber 660 and forwardly, as may be best seen in FIG. 14. The gases then flow downwardly past the front edge of the vane 724 into the lower portion of the chamber 660, and then rearwardly through the arch 592 into the secondary settling chamber 596, as best shown in FIG. 11.

The vane or damper 724 comprises a baffle which is variable in orientation and accordingly variable in effect with respect to the flow of the combustion gases and particulate matter in the chamber 660. The slowing down of the gases as they flow into the chamber 660 from the grids 604 allows the particulate matter, such as fly ash, to settle out of the gases and onto the floor of the chamber 660, the floor being the portion of the plate 508 between the walls 600 and 630 and the walls 534 and 590, as shown in FIGS. 13 and 14, respectively. The heavier particulate matter accordingly settles out of the flow of the combustion gases in the primary settling chambers before the gases flow through the arches into the secondary settling chambers and thence upwardly into the tertiary settling chamber. (Note that the top of the passageway 670, on top of plate 676 within chamber 596, may be considered as a fourth location for the settling of fly ash.)

The extended path of travel of the combustion gases allows the gases the opportunity of flowing in velocity and also allows the gases longer contact with the metal (steel) walls which surround the various chambers through which the combustion gases flow. The increase in time increases the efficiency of the transfer of the heat from the gases to the metal walls and to the fins secured to the metal walls, and from the metal walls and fins to the flow of air in the various air chambers, as heretofore described. In this manner the furnace fireplace apparatus is efficient in burning a wide variety of fuels, such as exotic fuels, as well as more conventional fuels. The apparatus is also efficient in transferring heat from the combustion processes in the combustion chamber to the air flowing in the chambers adjacent to the primary and secondary combustion chambers and adjacent to the various chambers through which the combustion gases flow. Accordingly, very little heat and very few particles of combustion are not recovered in the fireplace furnace apparatus prior to escape into the atmosphere through the combustion gas flue.

It will be noted, as in other embodiments, that the walls of the heated air chambers are finned. Where combustion air flows on both sides of a heated air chamber, both walls of the heated air chamber are usually finned. For example, fins 613 and 620 extend into chamber 618 from walls 612 and 558, respectively, as shown in FIG. 11. Similarly, fins 601 and 608 extend into chamber 606, as best shown in FIG. 13.

Figure 15:
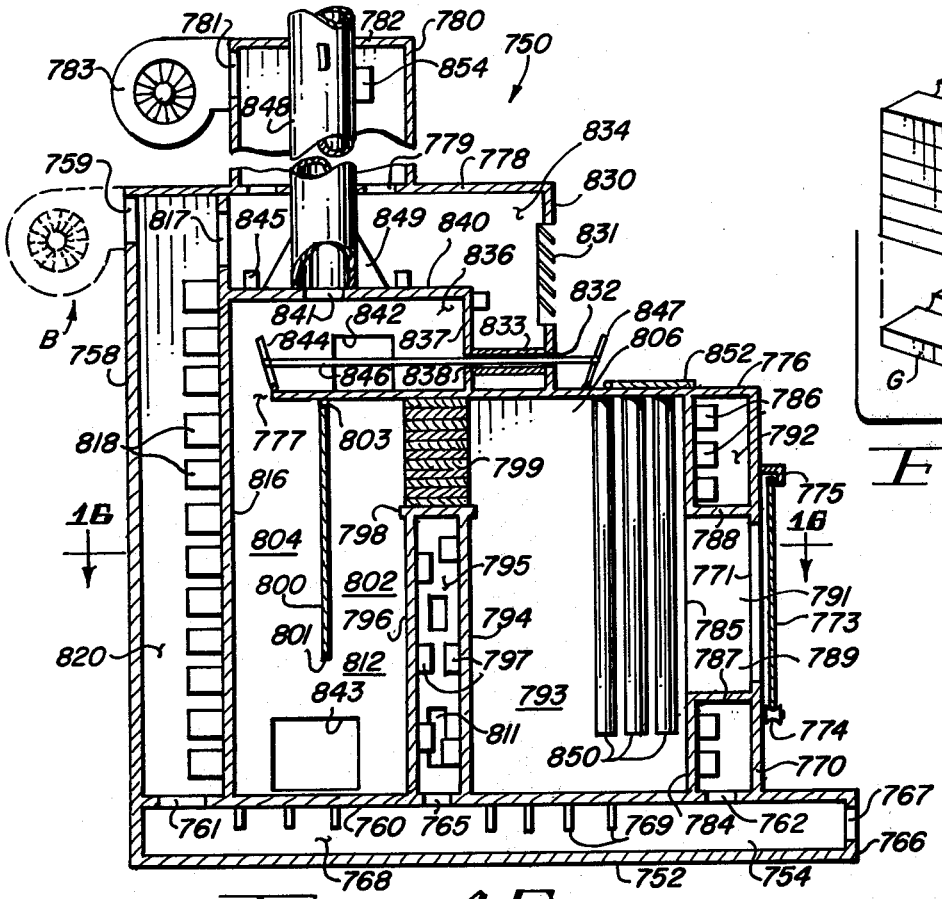
FIG. 15 is a view in partial section of an alternate embodiment of the furnace fireplace apparatus of the present invention, taken generally along line 15—15 of FIG. 16.
Figure 16:
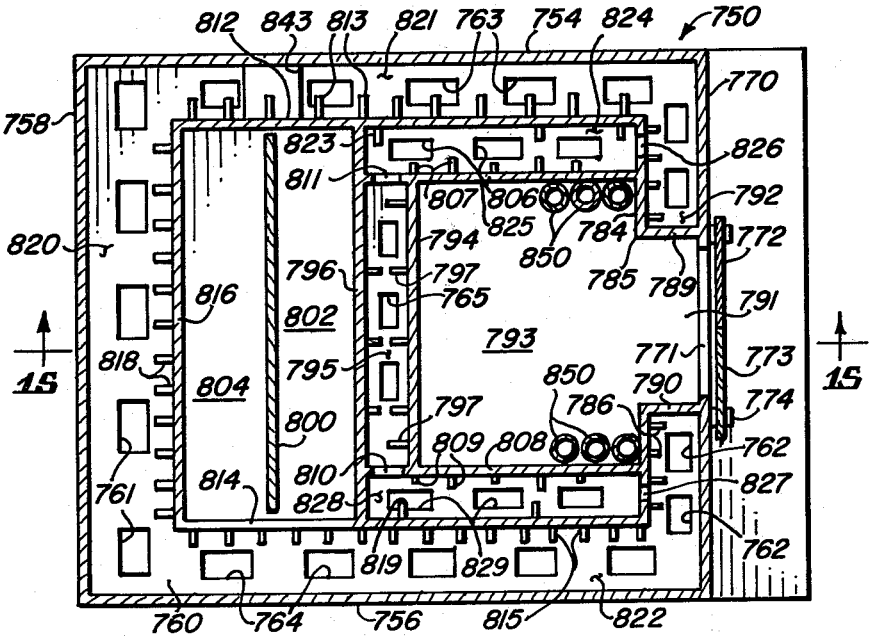
FIG. 16 is a view in partial section of a portion of the apparatus of FIG. 15 taken generally along line 16—16 of FIG. 15.

FIG. 15 is a view in partial section of an alternate embodiment of the fireplace furnace apparatus discussed above in conjunction with FIGS. 1-14. Rather than a parallel disposition of smoke scrubbers or smoke grids on opposite sides of the combustion chamber, as in the previous embodiments, the apparatus of FIG. 15 uses only a single row of grids located at the rear of a firebox. FIG. 16 is a view in partial section of the fireplace furnace apparatus of FIG. 15 taken generally along line 16—16 of FIG. 15. FIG. 16 thus comprises a plan view, in partial section, of the fireplace furnace apparatus of FIG. 15. FIG. 15 also comprises a view in partial section of the apparatus of FIG. 16, taken generally along line 15—15 of FIG. 16, and it comprises a side or elevational view of fireplace furnace apparatus 750. Reference will be made to both FIGS. 15 and 16 in the following explanation.

Fireplace furnace apparatus 750, illustrated in FIGS. 15 and 16, includes a bottom plate 752 to which is secured a right outer wall 754, a left outer wall 756, and a rear outer wall 758. The three outer walls, as with the other fireplace furnace embodiment discussed above, are appropriately secured together, as by welding, to provide an integral outer enclosure. The back or rear wall 758 may include an aperture 759, about which may be secured a fan or blower B, as will be discussed in detail below. The fan or blower B is shown in phantom in FIG. 15 disposed about the aperture 759.

Spaced apart upwardly from the bottom plate 752 is a floor plate 760. The floor plate 760 is substantially parallel to, and the same size as, the base plate 752. The floor plate 760, as with the floor plate of the other embodiments heretofore discussed, is also appropriately secured to the right and left outer walls and to the rear wall.

With respect to the floor plate 760, a plurality of apertures extend through the floor plate to provide communication between a plurality of chambers, as will be discussed below, disposed above the floor plate with a plenum chamber 768 which extends between the floor plate and the bottom plate. The plurality of apertures include apertures 761, 762, 763, 764, and 765. The various apertures are best shown in FIG. 16, but some of the apertures are also shown in FIG. 15.

A lower front wall 766 extends between the right outer wall 754 and the left outer wall 756, and between the bottom plate 752 and the floor plate 760. The lower front wall is appropriately secured to the four panels or plates comprising the walls, the floor plate, and bottom plate. A plurality of apertures 767, one of which is illustrated in FIG. 15, extends through the front wall 766 to allow communication between the plenum chamber 768 and the room or structure in which the furnace fireplace apparatus 750 is disposed. Heated air flows from the plenum chamber 768 outwardly through the apertures 767. However, as with the other plenum chambers, the plenum chamber 768 may also be connected to ducting for appropriate distribution of heated air. A plurality of fins 769 extends into the plenum chamber 768. The fins are secured to the floor plate 760, and the function as heretofore discussed with respect to fins of other embodiments.

A middle front wall 770 extends upwardly from the floor plate 760 substantially parallel to the lower front wall 766, but set rearwardly back from the lower front wall 766. The middle front wall 770 is appropriately secured to the floor plate 760 and to the right and left outer side walls or panels 754 and 756, respectively. The middle front wall 770 includes an opening 771 through which fuel is passed into and through a passageway 791 and into a firebox 793. Ashes and other residue from combustion within the firebox 793 is also removed through the passageway 791 and through the opening 771. The opening 771, and the passageway 791, are closed by a pair of sliding doors 772 and 773. The doors 772 and 773 slide outwardly, parallel to the wall 770, on rollers 774 which are appropriately secured to the wall 770. The rollers 774 are disposed at the bottom of the doors. The top of the doors 772 and 773 is disposed within a bracket 775 which is also secured to the wall 770. The bracket 775 may be a piece of angle iron, or similar material, which simply acts as a guide to retain the doors in their appropriate orientation against the wall 770. The doors also include chambers or brackets which fit over the rollers to insure a tight fit against the front wall 770. Additional seals may be incorporated into the doors, if desired. The object is, of course, to provide a substantially airtight fit of the doors in front of the opening 771 to prevent leakage of air in or smoke out, particularly when the damper is substantially closed.

A middle plate 776 extends between the right and left outer walls 754 and 756 substantially parallel to the bottom and floor plates 752 and 760. The middle plate 776 is secured at its front end to the upper portion or top of the intermediate or middle front wall 770, to the side walls 754 and 756, and, at its rear, to a rear inner wall 816. The rear inner wall 816 is spaced apart from the back or rear wall 758 and it extends upwardly from the floor plate 760 to a top plate 778.

A damper opening 777, best shown in FIG. 15, extends across the middle plate 776 adjacent the inner rear wall 816. The damper opening 777 will be discussed in detail below.

An upper front wall 830 extends upwardly from the intermediate or middle plate 776, to the upper portion of the outer walls 754 and 756, and at the top it is secured to an upper or top plate or panel 778. The top plate or panel 778 is also secured to the outer walls 754 and 756 and to the back plate or panel 758 and also to the rear inner wall 816. An aperture 779 extends through the top plate or panel 778. Substantially concentric with the aperture 779, and extending through the aperture 779, is a chimney flue 848, through which flow the combustion gases from combustion which takes place within the firebox or combustion chamber 793.

An outer stack 780 is disposed concentrically with respect to the aperture 779 and also with respect to the chimney flue 848. However, the outer stack 780 is disposed outwardly from both the flue 848 and the aperture 779. As illustrated in FIG. 15, the outer stack 780 is topped by a top panel 782 which is secured to both the flue 848 and the outer stack 780. The outer stack also includes an aperture 781. A blower 783 is appropriately secured about the aperture 781 for providing a forced flow of air into the outer stack 780, downwardly through the aperture 779, and through various heated air chambers of the furnace fireplace apparatus 750. The heated air eventually flows into the plenum chamber 768 and outwardly through the aperture 767 into the room or structure in which the fireplace furnace apparatus 750 is disposed. As indicated previously, ducts may be connected to the plenum chamber for transporting heated air to various rooms, etc. Moreover, the blower 783 may be used to provide return air to the apparatus 750, or it may be connected to a source of fresh, outside air, as desired.

Returning again to the firebox 793, from FIGS. 15 and 16 may be seen that the front of the firebox is defined by a front wall 784, which is spaced rearwardly from the middle front wall 770. The firebox front wall 784 includes an opening 785 which comprises one end of the passage 791. The passage 791 is closed or is defined by four panels, including a bottom panel 787, a top panel 788, a right side panel 789, and a left side panel 790.

Between the panels or plates 770 and 784, and about the passage 791, is a heated air chamber 792. The chamber 792 is defined by the walls or panels 770 and 784, the plate 776, the floor plate 760, and the right and left outer walls 754 and 756. Disposed within the chamber 792 are a plurality of fins 786 which are secured to the front firebox wall 784. A plurality of apertures 762, which extend through the floor plate 760, provide communication between the chamber 792 and the plenum chamber 768.

The side walls of the firebox or combustion chamber 793 comprise a pair of panels or plates 806 and 808, both of which are seen in FIG. 16, but only one of which, the right side wall or panel 806, is shown in FIG. 15.

The rear of the firebox is defined by a plate or panel 794 which comprises one of a pair of walls or plates which supports a plurality of grids 799. Parallel to the wall 794 is the other of the pair of walls, comprising a wall or panel 796. A grid plate 798 is appropriately secured to the spaced apart walls or plates 794 and 796. A plurality of smoke scrubbers or grids 799 extend from the grid plate 798 upwardly to the top of the combustion chamber, which is the middle plate 776.

Between the plates or panels 794 and 796, and downwardly from the grid plate 798, is a chamber 795. A plurality of apertures 765, which extend through the floor plate 760, provides communication between the chamber 795 and the plenum chamber 768. The floor plate 760 comprises the bottom to the chamber 795. A plurality of apertures 811, which extends through the wall 806, also provides communication between the chamber 795 and an adjacent chamber 824, as best shown in FIG. 16. Similarly, a plurality of apertures 810 which extends through the wall panel or plate 808, provides communication between the chamber 795 and an adjacent chamber 828, as best shown in FIG. 16.

As fuel, which may be any appropriate common or exotic fuel, is combusted within the combustion chamber or firebox 793, the gaseous and particulate products of combustion flow out of the firebox 793 through the grids 799 into a down pass or settling chamber 802. The down pass or settling chamber 802 is rearwardly of the grids and rearwardly of the rear grid wall 796. The chamber 802 extends between a pair of inner walls 812 and 814, which are respectively the right and left inner walls, and a curtain 800. The right and left inner walls 812 and 814 are spaced apart inwardly from the outer walls 754 and 760, respectively, and they extend front to back between the front combustion wall 784 and the inner rear wall 816. The chamber 802 thus comprises a primary settling chamber for particulate matter which flows through the grids 799 and which is not combusted either in the firebox 793 or in the grids 799. The down pass or settling chamber 802 may also be referred to as a secondary combustion chamber, for the reasons given above with respect to the other embodiments and their respective settling chambers adjacent their grids.

The curtain 800 extends between the walls 812 and 814 and downwardly from the middle plate 776. Beneath the curtain 800 is an arch 801 through which the gaseous products of combustion, and some particulate matter, flows from the down pass or chamber 802 into a second settling chamber 804, which comprises a continuation of the chamber 802. The chamber 804 is defined by the rear inner wall 816, the curtain 800, and the side walls 812 and 814.

The curtain 800 is secured to the walls 812 and 814 adjacent the middle plate 778 by a pair of hinges 803 to allow for expansion and contraction of the curtain. A pipe welded to each wall and rods welded to the curtain and extending into each pipe may serve as hinges.

The chambers 802 and 804 allow the gases flowing through the grids 799 to slow in their velocity, and accordingly to expand, and thus allow particulate matter to settle onto the floor 760 of the chambers, particularly the floor portion 760 of the chamber 804. The settling of the fly ash and other particulate matter occurs primarily in the chamber 804 because the gases must flow beneath the curtain 800, through the arch 801, and upwardly into the chamber 804. The upward flow of the gases, after slowing in velocity, allows the particulate matter to settle out. The heavier particles of course are the first to settle out.

A cleanout 843 is provided for cleaning particulate matter from the chambers 802 and 804. The cleanout 843 extends through the wall 812 and through the outer wall 754. The cleanout 843 comprises a tunnel, sealed from the adjacent chamber 821 through which it extends, to provide direct communication between the exterior of the furnace fireplace apparatus 750 and the chambers 802 and 804.

A chamber 834 is defined between the upper front wall 830, the right and left side outer wall 754 and 756, respectively, and the inner rear wall 816. The plate 776 comprises the bottom or floor for the chamber 834. The top plate 778 comprises the top or ceiling of the chamber 834. Communication between the outer stack 780 and the chamber 834 is through the aperture 779 radially outwardly of the flue 848. The chamber 834 communicates with a rear chamber 820 through the apertures 817 which extend through the inner rear wall 816. Louvers 831 disposed in wall 830 provide direct communication between the chamber 834 and the room or structure in which apparatus 750 is disposed. In case of a power failure, opening louvers 831 allows heat to flow out of the apparatus 750.

As shown in both FIGS. 15 and 16, a plurality of fins 818 extend into the chamber 820 from the wall 816. Similarly a plurality of fins 845 extends into chamber 834 from the walls of the chamber 836.

Between the right inner wall 812 and the right outer wall 754 is another chamber 821. The chamber 821 extends between the metal plate 776 and the floor plate 760. Communication between the chamber 821 and the plenum chamber 768 is through a plurality of apertures 763. Communication between the chamber 834 and the chamber 821 is by a similar plurality of apertures, not shown, which extend through the plate 776. A plurality of fins 813 extend into the chamber 821 from the wall 812. Communication between the chambers 820 and 821 is substantially direct.

A chamber 822 is defined between the left outer wall 756 and the left inner wall 814, as best shown in FIG. 16. A plurality of fins 815 extends into the chamber 822 from the wall 814. The chamber 822 is substantially identical to the chamber 821. Communication between the chamber 822 and the plenum chamber 768 is by means of a plurality of apertures 764. A similar plurality of apertures (not shown) extends through the plate 776 to provide communication between the chamber 822 and the chamber 834. As with chamber 821, communication between chamber 822 and 820 is relatively direct.

Communication between the chamber 792 and the chambers 821 and 822 is also substantially direct.

Between the inner right wall 812 and the righ firebox wall 806 is a chamber 824. The chamber 824 is further defined by front firebox wall 784, wall 796, floor plate 760 and plate 776. A plurality of fins 807 extends into the chamber 824 from the walls 806. Communication between the chamber 824 and the plenum 768 is through a plurality of apertures 825, which extends through the floor plate 760. Communication between the chamber 824 and the chamber 792 is through a plurality of apertures 826 which extends through the front combustion chamber wall 784.

A chamber 828, which is substantially identical to chamber 824, extends between the left inner wall 814, the left firebox wall 808, the outer grid wall 796, the front firebox wall 784, and plates 760 and 776. A plurality of fins 809 is secured to the wall 808 and extends into the chamber 828. Communication between the chamber 828 and the plenum chamber 768 is through a plurality of apertures 829, which extend through the floor plate 760. Communication between the chamber 828 and the chamber 792 is by means of a plurality of apertures 827 which extend through the front firebox wall 784.

The chamber 795 communicates with both chambers 824 and 828 through a plurality of apertures 811 and 810 which substantially surround the firebox. The fins 769 extend downwardly into the plenum chamber 768 from the floor plate 760, the fins 807 and 809 extend into the chambers 824 and 828 from the walls 806 and 808, respectively, the fins 786 extend into the chamber 792 from the front wall 784, and the fins 797 extend into the chamber 795 from the wall 794. Similarly, although not shown, a plurality of fins extend downwardly into the chambers 821, 822, 824, and 828 from the horizontally extending intermediate or middle plate 776. There are, as illustrated in FIGS. 15 and 16, fins also extending into other chambers which are not directly adjacent the firebox 793, but which are adjacent chambers through which combustion gases flow. For example, the chamber 820 includes fins 818 secured to the wall 816, the chamber 821 includes fins 813 extending from the wall 812, and the chamber 822 includes fins 815 secured to the wall 814. Moreover, the chamber 834 includes fins 845 extending into the chamber from plates 837 and 840, which comprise walls of a damper chamber 836. Fins may also extend into the chamber 834 from the intermediate plate 776. The extensive use of the fins assures maximum heat transfer to the air flowing downwardly through the outer stack 780 and into the various chambers, and outwardly of the apparatus into the room or structure through the apertures 767 from the plenum chamber 768.

Chamber 795 is double finned, with fins 797 on both vertical walls 794 and 796. Similarly, chamber 824 is double finned with fins 807 on wall 806 and fins 823 on wall 812, and likewise is chamber 828, with fins 809 on wall 808 and fins 819 on wall 814.

Above the plate 776, and within the chamber 834, is a damper chamber 836. The damper chamber 836 extends from the inner wall 816 forwardly to a damper chamber front wall panel 837. The top of the damper chamber 836 is closed by a top wall or plate 840. An aperture 841 extends through the wall 840 and the flue 848 is sealingly secured to the plate or wall 840 about the aperture 841. The flue 848 is preferably welded to the plate or wall 840 to insure a gastight seal between the chamber 834 and the chamber 836.

A plurality of triangular fins 849 is shown in FIG. 15 as extending between the flue 848 and the plate 840. The fins 849, in addition to providing strength to the juncture of the flue 848 and the plate 840, also provide additional surface for the transfer of heat from both the chamber 836 and the flue 848 to the heated air flowing through the chamber 834. The additional heat transfer surface of the fins 849 in turn protects the steel flue or chimney stack 848 from burning and/or buckling due to the concentration of heat at the stack. Actually, the same thing may be said for the fins on the exterior walls of the firebox for all of the embodiments of the present invention. The use of fins transfers heat away from the fireboxes that could otherwise cause the walls of the fireboxes to burn and/or buckle.

The chimney flue 848 also includes a plurality of fins 854 secured to it and extending outwardly into the airflow within outer stack 780.

The chamber 836 comprises a third settling chamber, in addition to the bottom portions of chambers 802 and 804, in which particulate matter settles. An appropriate cleanout 842 provides communication between the exterior of the furnace fireplace apparatus and the chamber 836 for removing the particulate matter from the chamber 836.

Adjacent the damper opening 777, and pivotally supported within the chamber 836, is a damper 844. It will be noted that the opening 777 is not disposed directly beneath the aperture 841, which communicates between the chamber 836 and the chimney flue 848. Rather, the damper opening 777 is offset from the aperture 841, and direct communication between the opening 777 and the aperture 841 is blocked by the damper 844. This insures an additional length of travel in the path of the combustion gases, and any particulate matter flowing therewith, which additionally slows the gases down and allows the particulate matter to settle out in the chamber 836, and allows further exposure of the hot combustion gases to the heated metal plates of the fireplace furnace apparatus for heat transfer purposes.

A damper actuating rod 846 is secured to the damper 844. The rod 846 extends through an aperture 838 in the wall 837 of the damper chamber 836 and through an appropriate guide 833 secured to the wall 837 about the aperture 838. The rod 846 extends through an additional aperture 832 in the wall 830 and through guide 833 which is secured to the wall 830 about the aperture 832. The guide or tube 833 is appropriately sealed to prevent the intermixing of the gaseous products of combustion from the chamber 836 to the chamber 834 through which heated air is flowing. Exteriorally of the fireplace furnace apparatus 750, the damper actuating rod 846 is secured to a lever 847. The lever 847 is appropriately secured for pivotal movement on the middle plate 776. The frictional engagement between damper 844, rod 846, actuator 847, and the plate 776 allows the damper to remain in any position between full open and full closed. The gradual closing of the damper contributes substantially to reducing the velocity of the combustion gases.

The center portion of the middle plate 776, disposed above the combustion chamber 793, may be used, if desired, as a hot plate for cooking purposes, and the like. Heat from the portion of the plate 776 directly over the combustion chamber or firebox 793, and not otherwise directly exposed to the chambers 792, 821, 822, 824 is thus directly transferable or usable.

A plurality of tubes 850 extends downwardly from the intermediate plate 776 into the firebox 793. The tubes 850 preferably terminate above the fire bed disposed in the firebox. The tubes 850 are covered on the top of the plate 776 by plates, such as plate 852, shown in FIG. 15. The plate 852 is appropriately pivotally secured to the plate 776 and the extent to which the plate 852 is pivoted above the surface of the plate 776 controls or governs the air flowing downwardly through the tubes 850 into the firebox 793.

When the thermostat which controls the combustion processes of the furnace fireplace apparatus 750 by providing compressed air to the fireplace furnace apparatus, as discussed previously, causes the compressed air to turn off, the problem of puffback is obviated by providing a slight flow of air through the tubes 850 to the firebox 793. Thus, the use of the tubes 850 comes into play when the thermostat is not calling for heat. The combustion processes within the firebox are at a minimum during the period of time when no heat is required, and therefore when no air or oxygen for combustion is being provided. The flow of air through the tubes 850 is sufficient to reduce the problem of puffback.

Returning again to aperture 759 at the upper portion of the back plate or panel 758, and to the blower B shown in phantom disposed about the aperture 759, will be noted that the blower B has the opposite function from the blower 783, shown disposed about the aperture 781 in the outer stack 780. The aperture 759 may, if desired, be used to draw warm air from the fireplace furnace apparatus and from a room or structure through louvers 831 when a fire is required for heating hot water but not for providing room heat. Accordingly, the fireplace furnace apparatus 750, if disposed adjacent to an outside wall of a home or other structure, may be vented to the outside, in a manner similar to the embodiment of fireplace furnace apparatus 500 of FIGS. 10, 11, and 12. The blower B actually comprises an exhaust blower.

Although louvers 831 may be provided in wall 830, such as shown in FIG. 15, since the apparatus of FIGS. 15 and 16 is generally smaller than the apparatus of FIG. 10, the vented air may also be drawn through the apertures 767 in the lower front wall 766 and a reverse flow of air may then be drawn through the aperture 759 for venting purposes. Additionally, the Blower B may be connected by appropriate conduits to a heat storage bin of, for example, rocks. The excess heat thus stored in rocks or in some other medium in a bin may be used later for heating purposes.

FIGS. 17 and 18 comprise views in partial section of an alternate embodiment of the apparatus of FIGS. 15 and 16. FIG. 17 is a side view in partial section through a free-standing fireplace furnace apparatus 860, and FIG. 18 is a view in partial section of the apparatus of FIG. 17, taken generally along line 18—18 of FIG. 17. The fireplace furnace apparatus of FIGS. 17 and 18 is a smaller, free-standing version of the fireplace furnace apparatus 750 of FIGS. 15 and 16. In discussion of the fireplace furnace apparatus 860, reference will be made to both FIGS. 17 and 18.

The fireplace furnace apparatus 860 includes a base plate 862 which is supported by four legs, of which a front leg 864 and a rear leg 866 are shown in FIG. 17, and both rear legs, including rear leg 866 and a rear leg 867, are shown in FIG. 18. Louvers or grill 863 extend through plate 862.

A lower front plate or panel 868 is secured to the base plate 862, and a back plate or panel 870 is also secured to the base plate 862. The lower front plate 868 includes movable or adjustable louvers 869 secured to the plate 868 for controlling the airflow through the plate. The back plate 870 includes an opening 871 for a cleanout 946, which will be discussed in detail below. A pivotable door 872 is secured to the back plate 870 to cover the opening 871.

The sides of the fireplace furnace apparatus 860 include a right side plate or panel 888 and a left side plate or panel 890, as shown in FIG. 18. The side panels 888 and 890 are appropriately secured to the base plate 862, to the back plate 870, and to the lower front plate 868.

An aperture extends through the side plate 890 and receives a water pipe 980. The water pipe 980 will also be discussed in detail below. Another aperture 874 extends through the back plate 870 to receive a damper rod 903. The damper rod will also be discussed in detail below.

Parallel to, and spaced apart from, the back or rear wall or plate 870 is an inner rear wall 948. The wall 948 is secured to a floor plate 892 and extends upwardly therefrom. The inner wall or plate 948 is the same width as the plate 870, extending between the outer side walls 888 and 890, but its height is less because it extends upwardly only from the floor plate 892 and it terminates below a top wall 964. A chamber 959 is defined between the walls 870, 948, 888 and 890, upwardly from floor plate 862. A plurality of fins 952 extends into the chamber 959 from the wall 948.

Extending substantially parallel to the base plate 862, and spaced apart slightly upwardly therefrom, is the floor plate 892. Between the base plate 862 and the floor plate 892, the side plates 888 and 890, the lower front plate 868 and the back plate 870, is a plenum chamber 897. A plurality of fins 893 extends downwardly into the chamber 897 from the floor plate 892. The heat transfer and antibuckling purpose of the fins has been previously discussed in conjunction with other embodiments. A plurality of apertures 894 and 896 extend through the floor plate 892 to provide communication between the chamber 897 and side chambers, including a side chamber 918 and a side chamber 922, shown in FIG. 18. A plurality of apertures 947, shown in phantom in FIG. 17, extends through floor plate 892 to provide communication between chamber 959 and chamber 897.

Extending substantially parallel to the lower front plate 868, but spaced above and rearwardly therefrom, is a middle front plate 876. The plate 876 extends between the side plates 888 and 890 and upardly from the floor plate 892. The middle front plate 876 includes an opening 878 which provides access through the middle front plate into a combustion chamber or firebox 924 by way of a passage 928. Above the door opening 878 is another opening 880 in the middle front plate 876. The opening 880 comprises an opening into an oven chamber 881, which will be discussed in more detail below. The opening 880 is closed by an appropriately hinged door 886.

The door opening 878 is closed by a pair of outwardly sliding doors, such as door 882, shown in FIG. 17. The door 882 slides on rollers 883 secured to the middle front plate 876. The rollers 883 are disposed at the bottom of the doors. At the top of the doors is a guide 884, which is also secured to the middle front plate 876. The guide 884 is preferably angle iron secured to the plate 876.

A middle plate 898 extends rearwardly from the middle front plate 876. The middle plate extends substantially horizontally and is generally parallel to the base plate 862 and to the floor plate 892. A portion of the middle plate 898 comprises the top or ceiling for the combustion chamber 924, and also a portion comprises the floor of the oven chamber 881. The plate 898 extends laterally between the side plates 888 and 890. Rearwardly, the plate 898 terminates at the inner rear wall 948. The middle plate 898 includes a damper opening 899, which will be discussed below.

Spaced inwardly from the right outer wall 888, and substantially parallel thereto, is a right inner wall 916, which extends vertically between the floor plate 892 and the middle plate 898. Lengthwise, the right inner wall 916 extends from a front firebox wall 926 rearwardly to the rear inner wall 948. The chamber 918 is defined between the inner wall 916, the outer wall 888, above the floor plate 892, and below the intermediate plate 898. Communication between the chambers 897 and 918 is through the apertures 894. A plurality of fins 917 extends into the chamber 918 from the wall 916.

A left inner wall 920 is substantially parallel to the right inner wall 916 and to the outer wall 890, and spaced inwardly therefrom. It extends vertically and lengthwise between the respective plates or walls as discussed above with respect to the right inner wall 916. The chamber 922 is defined between the inner wall 920, the outer wall 890, and the horizontal plates 892 and 898. Communication between the chambers 897 and 922 is through the apertures 896. A plurality of fins 921 extends into the chamber 922 from the wall 920.

Between the floor plate 892 and the middle plate 898, and intermediate the vertically extending middle front plate 876 and a front firebox wall 926 is a chamber 932, shown in FIG. 17. The wall 926 is substantially parallel to the wall 876 and spaced apart slightly therefrom. The wall 926 includes an opening 927, which is substantially parallel to the opening 878 in the wall 876. A plurality of fins 931 extends into the chamberS 932 from the front firebox wall 926. The openings 878 and 927 in the walls 876 and 924, respectively, are sealed from the chamber 932 by four walls or panels which define the passageway 928 through which fuel is loaded into the firebox 924. The passage 928, as best shown in FIG. 17, includes a top wall or panel 929, a bottom wall or panel 930, a right side wall or panel 933, and a left side wall panel, not shown. The passageway 928, with its four walls, accordingly extends through the chamber 932.

A plurality of apertures 895 provides communication between the chamber 932 and the plenum chamber 897. The apertures 895 extend through the floor plate 892.

The firebox 924 is defined by the floor plate 892, the middle plate 898, which comprise respectively the floor and ceiling for the firebox chamber, the front firebox wall 926, and a grid wall 934. The grid wall 934 comprises the rear wall for the firebox 924.

A grid plate 936 is secured to the top of the grid wall 934, which is in turn secured to the floor plate 892 and to the right and left inner walls 916 and 920. A plurality of grids 938 are disposed on the grid plate 936 and extend upwardly to the middle plate 898.

Parallel to the rear or back firebox wall 934 and the inner rear wall 948 and between them is a curtain 940. The curtain 940 is secured to walls 916 and 920 by hinges 943. The hinged connection has been described above in connection with FIGS. 15 and 16. Within firebox 924 are a pair of air pipes 982 and 984, shown in detail in FIGS. 20 and 21.

As seen in FIGS. 17 and 18, the water pipe 980 extends into the firebox 924, where it includes a plurality of serpentine coils 978 adjacent the top or ceiling of the firebox, which is the intermediate or middle plate 898. In addition to the coils of the water leg in the firebox 924, inlet and output portions of the water pipe 980 extend through the walls 920 and 890. The coils of the water leg are preferably disposed entirely within the firebox 924. As shown in FIG. 18, the pipe 980 extends through a sleeve 981 which is secured to the walls 890 and 920 in chamber 922. The pipe 980, and its coils 978, are secured to the middle plate 898 in an appropriate, well known manner.

The pipe 980 is shown in FIG. 18 as extending through the walls 890 and 920. The inlet and outlet pipes extend through apertures in the outer side wall 890 and in the firebox wall 920 about which the sleeve or guide 981 is secured. The sleeve 981 is appropriately insulated about the pipe and sealed, as required, to prevent the flow of heat and gases out of the combustion chamber through the sleeve. From the cumbustion chamber 924, the flow of combustion gases is thus through the grids 938, and downwardly between the curtain 940 and the grid wall 934, and through an arch 941 between curtain 940 and floor plate 892 and upwardly between the curtain 940 and the wall 948.

Between the grid wall 934 and the curtain 940 is a secondary combustion chamber 942, which also comprises a primary settling chamber at the bottom. A second settling chamber 944, which is a continuation of the chamber 942, is disposed between the curtain 940 and the rear inner wall 948. The settling of the particulate matter takes place in both chambers 942 and 944 as the gases and unburned products of combustion flow from the grids 938 downwardly in chamber 942 and upwardly in chamber 944. The gases, with ever finer particulate matter, flow upwardly through the chamber 944 and through the damper opening 899 in the horizontal plate 898 into a damper chamber 905. The particulate matter from chambers 942 and 944 is removed through the cleanout 946 which extends from the rear wall 870 through the inner wall 948, and to the two chambers 944 and 942. The cleanout 946 is closed by the door 872 which is appropriately hinged on the back or rear panel 870.

Parallel to the middle or intermediate plate 898, and spaced upwardly therefrom is an upper plate 908. The upper plate 908 extends from the middle front plate 876 rearwardly to the inner rear wall or plate 948, and laterally between the outer right wall 888 and the outer left wall 890. Within a space defined by the upper plate 908, the intermediate plate 898, the front plate 876, the inner rear plate 948, and a pair of upper inner side walls 954 and 956 (see FIG. 18) are a pair of chambers, including the damper chamber 905, and the cooking or oven chamber 881. The door 886 opens to provide access to the oven chamber 881 through the opening 880 in the middle front plate 876.

An inner wall 960 divides the oven chamber 881 from the damper chamber 905. An aperture 961 extends through the vertical inner wall 960 to provide communication between the two chambers, as desired. The aperture 961 may be closed, as by a spinner valve, which may be variably opened and closed, as required. When using the chamber 881 as an oven, the aperture 961 is preferably closed. However, if the chamber 881 is used for barbeque purposes, with fuel disposed in the chamber, then the aperture 961 will preferably be opened to allow for the passage of the gaseous products of combustion from the fuel, e.g., charcoal, disposed within the chamber 881 to flow into the damper chamber 905 and thence out of the fireplace furnace apparatus 860 through a chimney flue 912.

The damper chamber 905 extends between the wall 960 and the wall 948 and, laterally, between the pair of upper inner side walls 954 and 956, as best shown in FIG. 18. The wall 954 is a damper chamber right wall, and the wall 956 is a damper chamber left wall. The rear portion of the upper plate 908 comprises the top or ceiling for the damper chamber 905. Within the damper chamber 905 is a damper 902, discussed below. As with the dampers in the other embodiments, damper 902 is fully adjustable between open and closed positions.

An aperture 910 extends through the plate 908 from the chamber 905. Disposed about the aperture 910, and sealingly secured to the plate 908, is the chimney flue 912. In addition to being welded to the plate 908, a plurality of fins 914 are also welded to the flue 912. The fins 914 provide two primary functions, that of providing structural integrity and that of conducting heat away from the flue 912. These primary functions have been discussed above with respect to the fins secured to the chimney flues in the other embodiments. Fins 913 are also secured to the flue.

A cleanout 906 extends from the damper chamber 905 through the wall 954 and through the outer wall 888. The cleanout 906 is closed by a door 907 appropriately hingedly secured to the wall 888.

Extending partially over the aperture 899 in the horizontal intermediate plate 898 is a plate 904. The plate 904 extends upwardly and forwardly from adjacent the juncture of the intermediate wall 898 and the inner rear wall 948, and it partially overlies the opening or aperture 899. The plate 904 comprises a rest for a damper 902. The damper 902 is pivotally secured to the plate or wall 898 opposite the plate 904 across the aperture 899. The damper 902 is also secured to a damper rod 903 which extends through the aperture 874 in the wall 870 and through the aperture 950 in the wall 948. A guide 958 is secured to the wall 870 about the aperture 874, and the guide or tube 958 extends to and is secured to the wall 948 about the aperture 950. The damper rod 903 extends through the guide or pipe, which is appropriately sealed to prevent contamination of the heated air, which flows between the walls 870 and 948, by the gaseous products of combustion flowing in the damper chamber 905.

The damper chamber 905 comprises a tertiary settling chamber for the fly ash or other particulate matter flowing with the gaseous products of combustion from the chamber 944 upwardly through the aperture 899, past the damper 902 and the plate 904, and into the chamber 905. From the chamber 905, the gases flow upwardly through the aperture 910 in the upper wall 908 and upwardly through the flue 912. The plate 904 and the damper 902 cooperate to insure that the gases, with any particulate matter therewith, do not flow in a relatively straight line between the aperture 899 and the aperture 910. Rather, the gases must flow in an elongated path which results in a swirling effect within the chamber 905. The elongated flow or swirling effect thus allows the gases to slow still more in their travel. This, in turn, results in more particulate matter settling out onto the bottom of the chamber 905, and it also allows the hot gases more time to contact the walls of the chamber 905 for heat transfer purposes. Fins may be disposed both within and without the chamber 905 to aid in heat transfer, as desired. For cleanout purposes, the fins will, of course, not be disposed within the chamber 905 upwardly from the plate 898, but rather the fins will extend into the chamber 905 from the walls 960, 948, and 908.

Extending upwardly from the upper plate 908 in general alignment with the wall 960 is an upper front wall 962. The upper or top front wall 962 is secured to the top plate 908 and it extends between the outer walls 888 and 890, as shown in FIG. 18. A top plate 964 is secured to the wall 962 substantially horizontally, and parallel to the plate 908, the plate 898, the floor 892, and the base plate 862. The wall or plate 964 is secured to the wall 962, the walls 888 and 890, and the rear wall 870. It comprises the top of the fireplace furnace apparatus 860.

Adjustable louvers 963 are secured in the wall 962. The louvers 963 may be adjusted, as desired, according to the desired air flow. That is, air may flow out of the fireplace furnace apparatus 860 through the louvers 963 or, if desired, the air from within the room or structure in which the fireplace furnace apparatus 860 is disposed may flow inwardly through the louvers 963 and be vented exteriorally of the structure, as desired, by an appropriate blower, as shown in FIGS. 5 and 15.

An aperture 966 extends through the top plate or wall 964. Disposed about the aperture 966, and sealingly secured, as by welding, to the plate or wall 964, is an outer stack 968. Within the outer stack 968 is a chamber 969. The flue 912 extends through the aperture 966 and through the chamber 969 in the outer stack 968. The chamber 969, between the flue 912 and the outer stack 968, connects with a duct 970. The diameter of the aperture 966 is substantially greater than the diameter of the flue 912, and accordingly air flows through the aperture 966 from chamber 969 within the outer stack 968 and downwardly substantially unimpeded.

Above the damper chamber 905, and bounded by the plates 908, 964, 962, 870, 888, and 890, is a chamber 967. As shown in FIG. 18, the plate 908 includes a plurality of apertures which provide communication between chamber 967 and a pair of upper side chambers 919 and 923. A plurality of apertures 909 extends through the plate 908 to provide communication with upper side chamber 919, while a plurality of apertures 911 extends through the plate 908 to provide communication between the chamber 967 and the upper left chamber 923. As best shown in FIG. 17, there is direct communication between the chamber 967 and the chamber 959 which extends between the inner back plate 948 and the back plate 870. Fins 915 extend into chamber 967 from plate 908.

From the chamber 919, communication is provided with a lower chamber 918 through a plurality of apertures 900 which extends through the middle plate 898. A similar plurality of apertures 901 also extends through the plate 898 to provide communication between the chamber 923 and lower chamber 922, substantially parallel to the chambers 919 and 918. Thus, as best shown in FIG. 18, there is substantially direct communication between the bottom plenum chamber 897 and, on one side of the furnace fireplace apparatus 860, the chambers 918, 919, and 967, and on the opposite side of the furnace fireplace apparatus, the bottom plenum chamber 897 and the chambers 922, 923, and 967.

In FIG. 17, the communication between the chamber 897 and the chamber 932 is through the plurality of apertures 895. Due to the showing of the cleanout 946, FIG. 17 does not show the plurality of apertures 947 which extend through the floor plate 892 to provide communication between the chambers 897 and 959, except in phantom. Thus, as in the previous embodiments, there are double walls disposed about the firebox through which air flows. The air is heated by the transfer of heat from the metal (steel) walls of the apparatus directly and also from the many fins secured to the walls. The flow of air contacts the walls directly and flows over, under, and around the fins. The relatively long travel path for the air provides a substantial heat transfer and thus provides an efficient use of the heat energy generated.

The distribution of the heated air in the fireplace furnace apparatus 960 may be through louvers or apertures, such as the louvers 869, shown in the lower front plate 868, or through the louvers 963, shown extending through the top front wall 962. Obviously, there may be more louvers or apertures extending through the various walls or plates of the heated air chambers, as desired, such as louvers 863.

Shown in FIG. 18 as communicating directly with the chamber 969 within the outer stack 968 is the duct 970. A blower 972 is shown connected to both the duct and the outer stack to provide the forced air required to efficiently utilize the heat of the fireplace furnace apparatus 860. As with the other embodiments heretofore discussed, the air flow through the fireplace furnace apparatus 860 may be as desired. That is, the duct 970 may be used as a return duct to utilize the blower 972 to move the air downwardly from the duct 970, through the chamber 969, and downwardly and out through the various louvers. In the alternative, the duct 970 may be a distribution duct, with the air moving inwardly through the plenum chamber 897 of the fireplace furnace apparatus 860 and, ultimately, upwardly and outwardly through the chamber 969 and into the duct 970. Furthermore, the ductwork, with the blower, as with all embodiments herein, may be installed as illustrated in FIG. 4.

FIG. 19 is a view in partial section of the apparatus of FIG. 17, taken generally along line 19—19 of FIG. 17. It comprises a view in partial section through the chimney flue 912 and the fins 914. The flue 912 is illustrated as being generally circular in cross-sectional configuration, with the plurality of fins 914 extending radially outwardly from the flue 912. The fins 914 are appropriately secured to both the flue 912 and, as discussed above, to the upper plate 908, as shown in FIGS. 17 and 18. The fins provide structural strength in supporting the flue, and the fins also protect the flue by conducting heat away from the flue.

FIG. 20 is a perspective view of a portion of the apparatus of FIGS. 17 and 18, illustrating the interior of the fireplace furnace apparatus firebox 924 and the use of compressed air therein. FIG. 21 is a view in partial section of the apparatus of FIG. 20 taken generally along line 21—21 of FIG. 20. Both figures will be discussed together and accordingly reference will be made to both of them.

The firebox or combustion chamber 924 is shown in perspective in FIG. 20 looking toward the front firebox wall 926. The right inner wall 916, the floor plate 892, and the intermediate or middle plate 898, all of which serve to define the firebox 924, are each shown, but partially broken away, for clarity of illustration. Extending upwardly from the floor plate 892, and outwardly from the right side wall 916, is a lining of castable refractory material 990. It will be noted that the layer of the castable refractory lining material 990 extends only part way up the right wall 916 of the combustion chamber. Preferably, the refractory lining extends upwardly on the sides and on the back or rear of the combustion chamber which, in the embodiment of the fireplace furnace apparatus 860, comprises the grid wall 934 (see FIGS. 17 and 18), a distance of only about 12 to 14 inches. The entire bottom of the combustion chamber is preferably completely lined with the refractory material. Direct flame impingement on the walls causes damage, and the refractory material prevents the direct flame impingement and accordingly obviates the damage. The thickness of the lining is preferably about two to six inches, as needed.

Spaced outwardly from the wall 916 and from the layer of refractory material 990 secured thereto, is a bracket 986. The bracket 986 is welded to a rod 988, which is in turn welded to the front and rear walls of the combustion chamber 924. In FIG. 20, the rod 988 is shown welded to the front wall 926. The angle bracket 986 is illustrated as comprising a triangle with the wall 916, or the layer of refractory material 990 secured thereto, as comprising the base of an isosceles triangle, and with the arms or sides of the bracket 986 comprising the equal sides of the triangle. As shown in FIG. 21, the bracket 986 is spaced apart from the refractory material to allow dust to escape. Accordingly, ashes and other unburned products of combustion will not build up between the bracket 986 and the refractory material lining 990.

The pipes 982 and 984 extend through a sleeve or guide 989. The sleeve 989 is welded to walls 876 and 926 in chamber 932, as shown in FIG. 17.

Within the bracket 986 is a pair of pipes 982 and 984. The pipes 982 and 984 are preferably made of stainless steel for heat resistant purposes. The pipes 982 and 984 are aligned in superimposed orientation, as shown in FIG. 21. The pipe 982 includes a plurality of apertures 983, and the pipe 984 includes a plurality of apertures 985. The apertures 983 in the pipe 982 are preferably aligned parallel with each other, and the apertures 985 and the pipe 984 are preferably aligned with each other. The apertures 983 point generally upwardly and inwardly into the firebox or combustion chamber 924, while the apertures 985 point generally downwardly and inwardly into the combustion chamber or firebox 924.

The bracket 986 includes a plurality of slots 987 which are aligned with the apertures or holes 983 and 985 in the pipes 982 and 984, respectively. The pipes 982 and 984 convey compressed air which is delivered into the firebox 924 through the holes 983 and 985. When a thermostat (see schematic in FIG. 1) used with the fireplace furnace apparatus 860 calls for heat, an air compressor (see FIG. 1) delivers compressed air to the pipes 982 and 984. The compressed air in turn exits from the pipes through the holes 983 and 985 into the upper and lower portions, respectively, of the fireplace furnace apparatus 860. The use of two pipes to provide air in both the upper and lower portions of the combustion chamber enhances the complete burning or combustion of the fuel within the firebox. The particular employment of air on top of the fire reduces, substantially, pollution, smoke, and the like. The provision of the compressed air toward the bottom or lower portion of the fire or firebox enhances the combustion taking place at that location. If desired, the pipes 982 and 984 may be movable so that they may be aimed through the slots 987, as desired.

When sufficient heat has been provided by the fireplace furnace apparatus 960 to satisfy the thermostat, the compressor is turned off and the compressed air ceases to flow through the pipes 982 and 984. Without sufficient oxygen for continued combustion, the fire within the combustion chamber or firebox accordingly tends to "go to sleep". At such time as there is a need for additional heat, the thermostat calls for the heat and the air compressor turns on to "wake up" the fire smoldering or "sleeping" within the firebox 924. This is the same principle applicable to all of the various embodiments discussed herein. Appropriate apparatus is provided, as discussed above, to prevent puff-back when no compressed air is called for by a thermostat.

Figure 22:
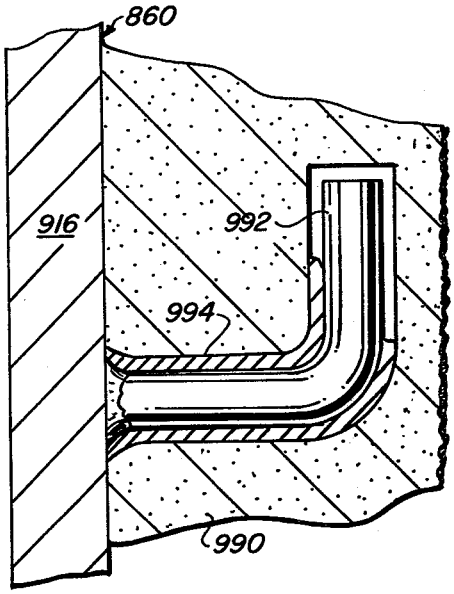
FIG. 22 is an enlarged view in partial section illustrating a detail of the combustion chamber shown in FIG. 20.

FIG. 22 illustrates the securing of the refractory material 990 to the wall 916 of the fireplace furnace apparatus 860. It comprises a view in partial section through the right side wall 916 of the firebox 924 of the fireplace apparatus 860.

A plurality of anchors 992 are appropriately secured, as by welding, to the wall 916. The anchors 992 are illustrated as being of a generally "L" shaped configuration, with one arm secured, as by welding, to the wall 916 and the other arm extending upwardly generally parallel to the wall 916. The anchors 992 are heavily coated with a layer 994 of paint after the anchors have been secured to the wall (and also to the floor) of the combustion chamber. After the layer 994 of paint has dried thoroughly, the refractory material is then placed on the walls and floor of the combustion chamber so that the anchors are covered by at least about three quarters of an inch of refractory material to prevent spalling. When the fireplace furnace apparatus is used, the thick layer of paint burns away to provide expansion space between the anchor and the refractory material to prevent the refractory material from cracking under use. A portion of the paint layer is shown burned away from around the top of the anchor 992.

As an alternative to using a thick layer of paint, plastic tape could be wrapped around the anchors. As the anchors heat under use, the tape burns away, leaving the expansion space.

While the refractory material has not been specifically discussed in conjunction with each embodiment, it is understood that the combustion chambers are lined on the bottom and upwardly on the sides with a layer of refractory material if the anticipated temperatures warrant it. Moreover, while the firebox doors in the Figures have been shown as a single metal plate, it is preferable to include refractory material as lining for the doors.

The use of refractory material, both plastic and castable, is known and understood. However, such material has not been used heretofore in fireplaces and heaters for homes simply because temperatures in the combustion chambers were not high enough to warrant its use. However, with the use of compressed air and exotic fuels, temperatures in the combustion chamber are substantially higher than in the prior art, and thus the use of refractory material may be warranted.

FIG. 23 is a perspective view of an interior wall W of a fireplace furnace apparatus, showing a plurality of fins F secured to the wall W. While the embodiments of the fireplace furnace apparatuses illustrated heretofore have shown the fins as being disposed in a regular configuration, the illustrative showings have been for convenience only. Rather than a generally regular arrangement, the fins F are preferably arranged in a variety of orientations and in a variety of shapes and sizes so as to maximize the efficiency of the heat transfer process. The fins are arranged randomly in both orientation and size so as to maximize the surface area of the fins exposed to the flow of air by the fins, and to provide the generally longest possible or practical path of travel for the air. All of this is for the purpose of maximizing the heat transfer between the air flow and the fins and walls to which they are secured. Moreover, the fins need not be rectangular, but virtually any and all types of steel, scrap or otherwise, plates, brackets, and the like, may be used.

Figure 24:
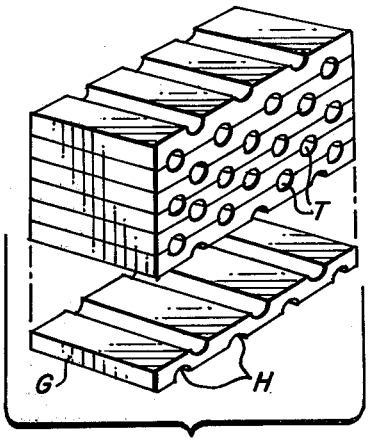
FIG. 24 is a perspective view illustrating details of grids used in the present invention.

FIG. 24 is a perspective view of a plurality of grid segments G, with one grid segment shown spaced apart from a stack of grid segments to illustrate the construction of the grids or smoke scrubbers discussed heretofore in the specification. The grid segments G are preferably made of ceramic material able to withstand elevated temperatures without distorting, cracking, and the like. Each grid segment G is of a generally rectangular configuration, with a length substantially greater than the width. The thickness of the grids is such to enable them to have, extending downwardly from the upper surface and upwardly from the lower surface of each grid, a plurality of semi-circular depressions or grooves H. The depressions or grooves extend substantially parallel to each other, and to the ends of each grid, and each comprises one half of a tube T. The depressions or grooves H are alternately staggered on the top and bottom surfaces of each grid segment G. Each groove H comprises one-half of a tube T.

The tubes T are formed when two or more grid segments G are mated together, as shown. The tubes are substantially cylndrical in configuration and are staggered from row to row to provide alternately aligned tubes in vertically adjacent rows.

As indicated previously, the grids are heated from the heat produced in the combustion chamber by the burning of the fuel, and they are further heated by the heat from the combustion gases or smoke, including the particles of combustion, which flow through the grids from a combustion chamber into a primary settling chamber. The temperature of the grids increases until a temperature of about 1200° F. is reached. When the temperature reaches about that point, the uncombusted matter and hydrocarbon gases, which produce noxious odors, begins to burn. As the temperature exceeds 1200° F., the burning of the hydrocarbons is substantially completed. The burning results in a virtually odor-free and smoke-free furnace fireplace apparatus. The fly ash residue and other particulate matter that is not burned either in the primary combustion chamber, which is the firebox, or in the grid tubes, or in a secondary combustion chamber (primary settling chamber) generally settles out of the flow of heated gases in one of the settling chambers before the gases ultimately flow out of the apparatus through the chimney flue.

The length of travel of the combustion gases or hydrocarbons through the grid tubes is, of course, limited to the length of the tubes, which length is substantially the width of each grid segment. Generally speaking, the width of each grid segment is about six inches, but may vary.

It will be noted that when the gases flow through the grid tubes they are exposed to highly concentrated heat. Since heat radiates at substantially a right angle from a hot surface, the heat radiates radially inwardly from the inner surfaces of the grid tubes T, thus concentrating the heat on the hydrocarbon gases, and on any particulate matter flowing with the gases, as they move through the grid tubes. It will also be noted that the flow through the grid tubes is substantially horizontal.

The apparatus of the present invention comprises furnace fireplace apparatus capable of burning exotic fuels which cannot be ordinarily burned in fireplace or furnace apparatus of the prior art. The arrangement of double chambers, and of fins extending into the double chambers from walls directly connected to the combustion process or to the flow of gases from the combustion process, through which heated air flows, provides substantially increased efficiency of heat transfer over prior art apparatus. This allows, volumetrically, less fuel to be burned in relation to the usable amount of heat derived from the apparatus. Moreover, the provision of settling chambers, and of the elongated path of the combustion gases, allows a substantial amount of particulate matter, unburnable, to settle out of the combustion gases prior to reaching the chimney flue. In addition, odors from hydrocarbon gases and smoke particles from incomplete combustion are substantially reduced with the apparatus of the present invention.

The employment of variable dampers also aids the efficiency of the disclosed apparatus. The damper may be adjusted to any desired degree of opening between full closed and full open, as required, for controlling the flow of gases going up the chimney and for controlling the flow of air for combustion. Generally, the damper should be wide open when initially starting a fire. When the draft is working properly, then the damper should be generally closed until a minimum position is reached.

The furnace fireplace apparatus is capable of burning trash or exotic fuels, as discussed above. The terms "trash" and "exotic fuels" include such things as newspapers, magazines, cardboard, sawdust, wood chips, rubber dust, dried organic material such as weeds, pine cones and needles, corn cobs, corn fodder, tree trimming chips, palm fronds, green tree bark, and dried manure. Obviously, wood fuel ordinarily burned in a fireplace also may be used with the present apparatus. When using ordinary wood or logs as fuel, the use of compressed air may not be necessary.

In the apparatus of the present invention, the employment of a relatively long and tortuous or winding path for the combustion gases and particulate matter, including the vertically upward and downward movement, causes the velocity of the gases and particulate matter to slow down appreciably after leaving the combustion chamber. This allows or encourages the unburned and unburnable particulate matter to settle out on the floors of the various settling chambers. At the same time, the use of the ceramic smoke scrubbers or grids, once they are heated to about 1200 degrees F. (684 degrees C.) results in secondary combustion of the odors, smoke, and other burnable residue, gases, and the like, which are not completely burned in the firebox or primary combustion chamber. Smoke and odors, which are the results or products of incomplete combustion, thus are subject or exposed to concentrated heat as they pass through the grids. Secondary combustion of such products results in substantially complete combustion of the burnable material in the fuel.

Particulate matter which is unburnable includes ash, fly ash, fines, etc. If subjected to a high enough temperature, such residue may fuse to form clinkers. The unburnable particulate matter settles onto the floors of the various settling chambers. The heaviest particulate matter settles out first, then the progressively lighter particulate matter settles out in turn. Only a very small amount of the particulate matter rises up the stack or flue.

One of the results or by-products of the use of the grids, in addition to substantially complete combustion of gases, odors, and smoke, is the elimination of sparks. The grids comprise excellent spark arresters by performing two functions. First, the limited size of the tubes in the grids limits the size of particulate matter which can pass through the grids. Particles that are too large to pass through the tubes accordingly remain in the firebox or primary combustion chamber until they are reduced in size by additional burning. Then, once the particles do enter into the tubes, they are subject to concentrated heat which promotes further, and hopefully complete, burning. Thus the problem of sparks leaving the apparatus through the chimney flue or stack is substantially eliminated. Only the unburnable residue, in very tiny or light particles, escapes, and of the particulate matter which does leave the apparatus, including the flue gases, the temperature of it is significantly reduced by the elongated path taken and the consequent exposure to metal (steel) walls, generally heavily finned, which results in the substantial transfer of heat, as discussed.

The use of fins in the heat transfer process has been rather extensively discussed herein. The additional function of providing structural strength has been discussed briefly for the fins or gussets which are welded to both the inner stacks or chimney flues and the plate defining the top or roof of the damper chambers. However, the fins also provide an additional function of stiffening the various walls or plates or panels, to prevent warping and buckling during the heating and cooling processes. "Fins", broadly defined to include all sizes and shapes of scrap iron, steel, etc., may be used. For exterior walls, angle iron may be welded to the walls for stiffening purposes, if desired. For interior walls, the use of fins is preferable.

The use of fins on the exterior of the firebox walls may also provide sufficient heat transfer so as to protect the walls of the firebox so that the use of refractory material, if not eliminated, may be substantially reduced.

In the apparatus of the present invention it will be noted that there are two separate chamber systems, one chamber system for the combustion gases and one chamber system for the heated air. The combustion gases flow from the combustion chamber or firebox through a plurality of chambers which define a relatively elongated path. The elongated path includes vertically upwardly and downwardly travel and horizontal travel and a combination of both. As has been adequately discussed, this allows time for substantially complete combustion to take place and also time for adequate heat transfer. Moreover, the elongated travel allows the combustion gases to slow in velocity to allow incombustible particulate matter to settle out of the gas flow.

It will be noted that the combustion gas chambers have double walls about them which define chambers through which the heated air flows for maximum heat transfer. Moreover, the interior of the heated air chambers contains fins which are secured to the walls which are in direct contact with the combustion gases. The use of the heavily finned walls maximizes the heat transfer, as discussed above.

The use of fins is continued on the exterior of the chimney flue or stack to recover a substantial amount of heat which is normally wasted. The fins secured to the exterior of the flue do double duty, as discussed above, in recovering heat that would be otherwise wasted up the chimney and also in protecting the chimney from an overheated condition which leads to chimney failure. Wasted heat which gets to the stack is difficult to recover in prior art apparatus, but such heat is not wasted in the apparatus of the present invention.

In the apparatus as disclosed herein, the path of the heated air is generally downwardly. This forced air flow is accomplished by means of a blower disposed at the upper portions of the furnace fireplace apparatus. Additional or auxiliary blowers may also be used to aid the air flow and/or to provide for venting unwanted heat out of the apparatus, and even for venting unwanted heat out of the room or structure in which the heater is disposed. Moreover, such unwanted heat may be blown into a heat storage bin for use at a later time.

As has been adequately discussed, the recovery of heat or heat transfer is the primary purpose of the fins. Structural considerations are secondary, but, while secondary, are nevertheless of importance. The more fins the better, and the shape and size of the fins is relatively unimportant in the transfer of the heat. Thus, virtually any type of iron or steel scrap may be used as fins. The more irregular the fins are, or the more randomly they are located, the greater the heat transfer due to the elongated path which the air must take to move against and around the fins.

The elongated path of the heated air allows for a substantially improved efficiency of heat transfer over prior art apparatus. A comparable heat transfer efficiency is accomplished by the elongated path and slowed velocity of the combustion gases. With respect to the combustion gases and combustion processes, three things are accomplished, all of which have been adequately mentioned. However, they go together: increased combustion, increased heat transfer, and increased settling of particulates. The increased length of travel or path of combustion gases allows more time for contact between the gases and the adjacent metal walls for heat transfer purposes. At the same time the gases are slowed to allow time for substantially complete combustion. Moreover, the elongated path also means more surface area for contact and heat transfer.

At the same time, the slowed velocity allows the unburned and unburnable particulate matter to settle out in the several chambers. The vertical upwardly and downwardly path of the combustion gases also encourages settling.

It will be noted that while some combustion takes place below 1200 degrees F., maximum combustion takes place at about that temperature, and accordingly that figure is used herein for discussion purposes concerning the ceramic smoke scrubbers or grids, and the effect on combustion which they have. Discussion on the subject is found in several places above.

The apparatus of the present invention, as shown in the several embodiments, includes common features, such as double walled hot air chambers adjacent combustion gas chambers, ceramic smoke scrubbers or grids, a plurality of fins in the hot air chambers, settling chambers for particulate matter, fully adjustable dampers, and compressed air piped into the firebox. Due to the relative complexity of the figures in the drawing, such features as the air pipes are not shown in each embodiment. Moreover, details of welding, of doors, door thickness, and insulation required on doors, such as refractory material, have been omitted for clarity because such is well known in the art. Similarly, the sealing of the guides or sleeves for air pipes and damper actuator rods is understood and accordingly not shown. Incidental features of the apparatus, which contribute to its overall efficiency, such as a water leg for heating water, duct work, louvers, and blowers for exhausting air or for heating during power outages, and references to stone bins or other heat storage areas, are shown and/or mentioned illustratively.

As has been stated, if a fuel such as wood is to be burned virtually exclusively, the compressed air may not be needed, although it may aid substantially in "waking up" a sleeping fire. However, if newspapers, magazines, and other exotic fuels are used, the compressed air is deemed of substantial importance in promoting combustion.

In locations where the use of a steel chimney flue is impractical, and a masonry flue with a terra cotta lining is used, the overall heat transfer efficiency of the apparatus may be less than maximum. Under such circumstances the steel portion of the apparatus, with the double walls and fins, should be extended as high as possible to allow as much heat transfer as can be accomplished under the circumstances.

The combustion of odors and smoke has briefly been maintained. The combustion of odors and smoke typically represents a secondary type of combustion which begins in the tubes or passages of the grids and may continue in the secondary conbustion chambers. Since odors and smoke are caused by incomplete combustion occurring in the firebox or primary combustion chamber, the odors and smoke must be subject to sufficient heat for a long enough time after they leave the firebox to allow them to burn. Also, adequate oxygen must be available to support the secondary combustion. Oxygen is provided by the compressed air, and the grids provide the heat while the combustion gases and products of combustion, including odors and smoke, flow through the passages in the grids.

Unless some type of pre-heater is used to heat the grids, until the grids are heated to about 1200 degrees F., the temperatures in the grids will generally not be sufficient for the combustion of odors and smoke. There may thus be a time lag after initially starting a fire and before the apparatus reaches its maximum efficiency for combustion purposes.

What is claimed is:

1. Furnace fireplace apparatus for burning a variety of fuels, comprising, in combination:

firebox means comprising a primary combustion chamber, including floor plate means, first and second side walls secured to the floor plate means and spaced apart from each other, front wall means secured to the floor plate means and to the first and second side walls, a rear wall spaced apart from the front wall and secured to the floor plate means and to the first and second side walls, a ceiling plate spaced apart from the floor plate means and secured to the front wall, the rear wall, and the first and second side walls;

a bottom plate disposed beneath and spaced apart from the floor plate means;

outer wall means disposed about and spaced apart from the firebox means and secured to the bottom plate, including outer front wall means, first and second outer side walls spaced apart from each other and secured to the outer front wall means, an outer back wall spaced apart from the outer front wall and secured to the outer side walls;

a top plate secured to the outer wall means;

a plurality of first heated air chambers between the firebox means and the outer wall means through which air flows;

plenum chamber means including a plenum chamber disposed between the floor plate means and the bottom plate and the outer wall means and communicating with the plurality of first heated air chambers for receiving the flow of air;

secondary combustion chamber means including a primary settling chamber communicating with the firebox means for receiving a flow of particulate matter and gaseous products of combustion from the primary combustion chamber from the burning of fuel and for slowing the velocity of the flow of particulate matter and gaseous products of combustion to allow particulate matter to settle out of the flow;

grid means comprising a plurality of grid tubes extending from the firebox means to the secondary combustion chamber means through which the particulate matter and gaseous products of combustion flow for providing heat for combustion of particulate matter and gaseous products of combustion;

a secondary settling chamber communicating with the secondary combustion chamber means for the settling of particulate matter from the flow of particulate matter and gaseous products of combustion;

damper chamber means disposed above the secondary settling chamber through which the flow of particulate matter and gaseous products of combustion flow and comprising a tertiary settling chamber for particulate matter;

flue means communicating with the damper chamber means for receiving the flow of gaseous products of combustion and any particulate matter therein not settled out in the settling chambers and for transporting the flow out of the furnace fireplace apparatus; and outer stack means disposed about the flue means and including a second heated air chamber through which the air flows and communicating with the plurality of first heated air chambers.

2. The apparatus of claim 1 in which the plenum chamber means includes a plurality of fins secured to the floor plate means for transferring heat from the floor plate to the flow of air in the plenum chamber means.

3. The apparatus of claim 2 in which the floor plate means of the firebox means extends beneath the firebox means, the secondary combustion chamber means, the secondary settling chamber, and the plurality of first heated air chambers, to define a substantially continuous floor above the plenum chamber means.

4. The apparatus of claim 3 in which the floor plate means includes a plurality of apertures extending therethrough to provide communication between the plenum chamber means and the plurality of first heated air chambers.

5. The apparatus of claim 4 in which the grid means includes a grid shelf for supporting the plurality of tubes adjacent the ceiling plate for providing a vertically upward path for the flow of the particulate matter and gaseous products of combustion in the combustion chamber to the grids and a vertically downward path from the plurality of tubes to the secondary combustion chamber means.

6. The apparatus of claim 5 in which the secondary settling chamber means includes a vertically extending curtain disposed between the secondary combustion chamber means and the secondary settling chamber means to separate the secondary combustion means from the secondary settling chamber means.

7. The apparatus of claim 6 in which the secondary chamber means further includes an arch between the curtain and the floor plate means through which the particulate matter and gaseous products of combustion flow from the primary settling chamber to the secondary settling chamber.

8. The apparatus of claim 5 in which the secondary combustion chamber means includes arch means adjacent the floor plate means through which the particulate matter and gaseous products of combustion flow from the primary settling chamber to the secondary settling chamber.

9. The apparatus of claim 8 in which the flue means includes a plurality of fins extending into the second heated air chamber for transferring heat from the flue means to further flow of air in the second heated air chamber.

10. The apparatus of claim 9 in which the outer wall means includes an inner back wall spaced apart from the back wall and secured to the first outer side wall, the second outer side wall, the floor plate means, and the top plate, and defining therebetween one of the plurality of first heated air chambers.

11. The apparatus of claim 10 in which the one of the first heated air chambers communicates with the plenum chamber means and with the second heated air chamber means to provide for a portion of the flow of air to the plenum chamber means.

12. The apparatus of claim 11 in which the inner back wall includes a plurality of fins extending into the one of the plurality of heated air chambers for transferring heat from the inner back wall to the flow of air through the one of the plurality of heated air chambers to the plenum chamber means.

13. The apparatus of claim 12 in which the ceiling plate of the combustion chamber means and the top plate are spaced apart to define, with the outer wall means, a third heated air chamber communicating with the plurality of first heated air chambers and with the second heated air chamber.

14. The apparatus of claim 13 in which the third heated air chamber is disposed about the damper chamber means.

15. The apparatus of claim 14 in which the damper chamber means includes a damper chamber for receiving the flow of particulate matter and gaseous products of combustion from the secondary settling chamber, an aperture between the damper chamber and the secondary settling chamber through which the particulate matter and gaseous products of combustion flow, and a movable damper adjacent the aperture for controlling the flow of particulate matter and gaseous products of combustion from the secondary settling chamber and the damper chamber.

16. The apparatus of claim 15 in which the plenum chamber means includes aperture means through which the air flows from the plenum chamber out of the furnace fireplace apparatus.

17. The apparatus of claim 16 in which the firebox means includes outer combustion chamber walls spaced apart from the first and second side walls and secured to the floor plate means, the first and second side walls, the front wall, the rear wall, and the ceiling plate and defining a plurality of fourth heated air chambers communicating with the plurality of first heated air chambers and with the plenum chamber means and through which a portion of the air flows to the plenum chamber.

18. The apparatus of claim 17 in which the outer combustion chamber wall means includes a plurality of fins secured to the walls of the firebox means and extending into the plurality of fourth heated air chambers for transferring heat from the walls of the firebox means to the flow of air through the plurality of fourth heated air chambers.

19. The apparatus of claim 1 in which the firebox means includes compressed air means for providing a flow of compressed air into the primary combustion chamber for the combustion of fuel.

20. The apparatus of claim 19 in which the compressed air means includes control means for controlling the flow of compressed air into the primary combustion chamber.

21. The apparatus of claim 20 in which the outer stack means includes blower means for forcing the flow of air through the second heated air chamber, the plurality of first heated air chambers, and the plenum chamber.

22. The apparatus of claim 1 in which the floor plate means of the firebox means extends beneath and comprises a floor for the primary combustion chamber, the secondary combustion chamber, and the secondary settling chamber.

23. The apparatus of claim 22 in which the secondary combustion chamber means includes a vane movable to vary the distance the particulate matter and gaseous products of combustion flow to further slow the velocity of the flow of particulate matter and gaseous products.

24. The apparatus of claim 23 in which the grid means are disposed adjacent the ceiling plate and the vane is disposed between the grid means and the floor plate means.

25. The apparatus of claim 24 in which the secondary combustion chamber means further includes an arch adjacent the floor plate means through which the particulate matter and products of combustion flow from the primary settling chamber to the secondary settling chamber.

26. The apparatus of claim 22 in which the firebox means includes outer first and second side walls spaced apart from the first and second side walls and secured to the floor plate means, the front wall, the rear wall, and the grid means and defining therein a first and a second inner heated air chamber through which air flows and communicating with the plurality of first heated air chambers and with the plenum chamber.

27. The apparatus of claim 26 in which the grid means includes a first and a second grid shelf secured respectively to the first and second side walls and outer side walls, and a first portion of the plurality of grid tubes extend from the first grid shelf to the ceiling plate and a second portion of the plurality of grid tubes extend from the second grid shelf to the ceiling plate.

28. The apparatus of claim 26 in which the firebox means further includes a plurality of fins secured to the first and second side walls and extending into the pair of inner heated air chambers for transferring heat to the flow of air in the inner heated air chambers.

29. The apparatus of claim 26 in which the firebox means further includes an outer rear wall spaced apart from the rear wall and secured to the floor plate means, the ceiling plate, and the first and second side walls and defining therein a third inner heated air chamber through which air flows and communicating with the first and second inner heated air chambers and with the plenum chamber.

30. The apparatus of claim 29 in which the firebox means further includes a plurality of fins secured to the rear wall and extending into the third inner heated air chamber for transferring heat to the flow of air in the third inner heated air chamber.

31. The apparatus of claim 30 in which the outer wall means includes an inner back wall spaced apart from the back wall and secured to the first and second outer side walls, the floor plate means, and the top plate and defines therebetween one of the plurality of first heated air chambers.

32. The apparatus of claim 31 in which the outer rear wall and the inner back wall comprise walls of the secondary settling chamber, which secondary settling chamber is disposed between the third inner heated air chamber and the one of the plurality of first heated air chambers.

33. The apparatus of claim 32 in which the front wall means of the firebox means extends and is secured to the outer first and second side walls of the firebox means and to the first and second outer side walls of the outer wall means and to the ceiling plate and to the floor plate means, and defines, between the outer front wall means, the first and second outer side walls, the floor plate means and the ceiling plate, another of the plurality of first heated air chambers.

34. The apparatus of claim 33 in which the outer wall means further includes first and second inner side walls spaced apart from the first and second outer side walls and secured to the inner back wall, the ceiling plate, the floor plate means, and the front wall means of the firebox means and defining within said walls and plate some of the plurality of first heated air chambers.

35. The apparatus of claim 34 in which the front wall means of the firebox means and the outer front wall means of the outer wall means includes a pair of aligned apertures through which fuel is provided for the primary combustion chamber.

36. The apparatus of claim 35 in which the secondary combustion chamber means includes first cleanout means for removing particulate matter from the primary settling chamber and from the secondary settling chamber.

37. The apparatus of claim 36 in which the damper chamber means includes second cleanout means for removing particulate matter from the tertiary settling chamber.

38. Apparatus for producing heat from burning fuel comprising, in combination:

combustion chamber means, including a front wall, a rear wall, a first and a second side wall, a floor, and a ceiling for burning fuel;

primary settling chamber means disposed adjacent the combustion chamber and communicating therewith for receiving a flow of combustion gases and products of combustion from the burning of fuel in the combustion chamber in which heavier unburned products settle out of the flow of combustion gases and products of combustion;

passage means extending between the combustion chamber means and the settling chamber means through which the combustion gases and products of combustion flow and disposed adjacent the ceiling of the combustion chamber for providing a vertically upward flow of the said gases and products from the combustion chamber and a vertically downward flow of the gases and products from the passage means into the primary settling chambers means;

secondary settling chamber means disposed adjacent and communicating with the primary settling chamber means for receiving the flow of combustion gases and products of combustion from the primary settling chamber means in which lighter unburned products of combustion settle out of the flow of combustion gases and products of combustion;

damper chamber means disposed above the secondary settling chamber means for receiving the flow of combustion gases and products of combustion from the secondary settling chamber means and comprising a tertiary settling chamber in which the lightest unburned products of combustion settle out of the flow of combustion gases and products of combustion, and including a damper opening between the secondary settling chamber means and the damper chamber means, and an adjustable damper adjacent the damper opening and movable to control the flow of combustion gases and products of combustion from the secondary settling chamber means to the damper chamber means;

chimney flue means communicating with the damper chamber means for receiving the flow of combustion gases and products of combustion from the damper chamber means and for conducting them out of the apparatus;

wall means disposed about the combustion chamber means and comprising a plurality of panels defining the outer walls of the apparatus; and heated air chamber means disposed between the combustion chamber means and the wall means through which air flows for receiving heat from the combustion of fuel in the combustion chamber means.

39. The apparatus of claim 38 in which the heated air chamber means comprises a plurality of communicating chambers disposed adjacent the combustion chamber, the primary settling chamber means, the secondary settling chamber means, the damper chamber means, and the chimney flue means.

40. The apparatus of claim 39 in which one chamber of the plurality of heated air chambers is disposed between the primary settling chamber means and the secondary settling chamber means.

41. The apparatus of claim 39 in which heated air chamber means includes a plurality of fins secured to the front wall, the rear wall, the side walls, and the floor of the combustion chamber means and extending into the chambers of the heated air chamber means for conducting heat from the combustion chamber means and for transferring heat to the flow of air in the heated air chamber means.

42. The apparatus of claim 41 in which the combustion chamber means includes means for providing compressed air for supporting the combustion of fuel in the combustion chamber means.

43. The apparatus of claim 41 in which the passage means comprises a plurality of tubes extending from the combustion chamber means to the primary settling chamber means through which the combustion gases and products of combustion flow.

44. The apparatus of claim 43 in which the passage means further comprises a plurality of ceramic grids for heating the combustion gases and products of combustion to provide additional combustion thereof as they flow through the plurality of tubes.

45. The apparatus of claim 44 in which the passage means is disposed adjacent the ceiling of the combustion chamber means.

46. The apparatus of claim 41 in which the one of the plurality of chambers of the heated air chamber means comprises a plenum chamber disposed beneath the combustion chamber means, the primary chamber means, and the secondary settling chamber means.

47. The apparatus of claim 46 in which the heated air chamber means further includes a plurality of openings for allowing the flow of heated air to flow out of the apparatus.

* * * * *